US009370247B1

(12) United States Patent
Caldwell

(10) Patent No.: US 9,370,247 B1
(45) Date of Patent: Jun. 21, 2016

(54) WEB-STRAPPED FURNITURE, WEB-STRAPPING FOR FURNITURE, AND METHODS FOR WEB-STRAPPING FURNITURE

(71) Applicant: John W. Caldwell, San Marino, CA (US)

(72) Inventor: John W. Caldwell, San Marino, CA (US)

( * ) Notice: Subject to any disclaimer, the term of this patent is extended or adjusted under 35 U.S.C. 154(b) by 172 days.

(21) Appl. No.: 14/022,956

(22) Filed: Sep. 10, 2013

Related U.S. Application Data

(62) Division of application No. 13/296,671, filed on Nov. 15, 2011, now Pat. No. 8,550,565.

(60) Provisional application No. 61/533,686, filed on Sep. 12, 2011.

(51) Int. Cl.
*A47C 7/02* (2006.01)
*A47C 7/22* (2006.01)

(52) U.S. Cl.
CPC ..... *A47C 7/22* (2013.01)

(58) Field of Classification Search
CPC ..... A47C 7/22
USPC ..... 297/452.63, 440.11; 24/256 C
See application file for complete search history.

(56) References Cited

U.S. PATENT DOCUMENTS 2,839,126 A * 6/1958 O'Neill ..... 160/392
3,125,156 A * 3/1964 Grimshaw ..... 160/382
3,175,269 A * 3/1965 Raduns et al. ..... 24/265 C
3,677,601 A * 7/1972 Morrison et al. ..... 297/440.11
5,716,101 A * 2/1998 Frinier et al. ..... 297/440.22
5,769,500 A * 6/1998 Holbrook ..... 297/463.2
5,836,655 A * 11/1998 Laufer ..... 297/452.63
5,911,478 A * 6/1999 Goodman ..... 297/440.11
6,293,624 B1 * 9/2001 Gaylord et al. ..... 297/440.11
6,523,904 B1 * 2/2003 Vanderminden ..... 297/452.63
6,560,827 B1 * 5/2003 Gross ..... 24/265 C
6,779,849 B1 * 8/2004 Harper et al. ..... 297/452.13
7,125,081 B2 * 10/2006 Church et al. ..... 297/440.11
7,568,768 B1 * 8/2009 Tsai ..... 297/452.63
7,740,320 B2 * 6/2010 Chiang ..... 297/440.15
8,317,270 B2 * 11/2012 Tseng ..... 297/452.2
2005/0200189 A1 * 9/2005 Schultz et al. ..... 297/452.56

* cited by examiner

*Primary Examiner* — David R Dunn
*Assistant Examiner* — Tania Abraham
(74) *Attorney, Agent, or Firm* — Khorsandi Patent Law Group, A Law Corporation; Marilyn R. Khorsandi

(57) ABSTRACT

Exemplary embodiments of the present invention would provide web-strapping for upholstery of furniture, methods of providing web-strapping for upholstery of furniture, web-strapped furniture, and methods of web-strapping furniture. One exemplary embodiment of the present invention would provide an exemplary strap assembly of material for furniture upholstery comprising at least one fastener fastened into each end of the strap such that a tail end of each fastener is secured from extraction from the strap. In one exemplary strap assembly embodiment, fasteners would be fastened in each corner of each end of a strap so that a tail end of each fastener would be secured from extraction from the strap. Other exemplary embodiments would provide an exemplary article of furniture and methods of making an exemplary article of furniture, comprising said strap assemblies installed to span a space between opposing chair rails.

11 Claims, 20 Drawing Sheets

FIG. 5A
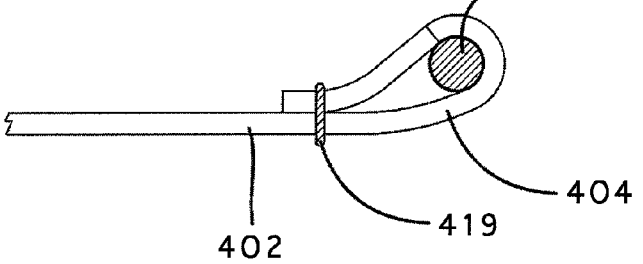
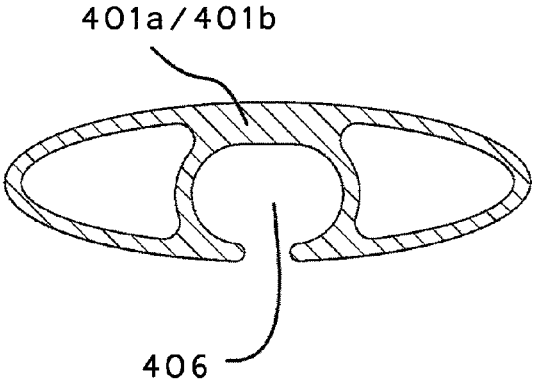
FIG. 5B
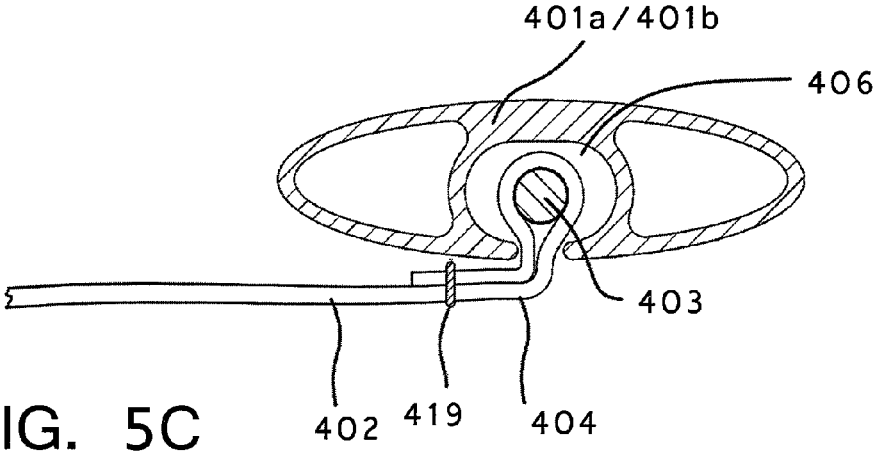
FIG. 5C

WEB-STRAPPED FURNITURE, WEB-STRAPPING FOR FURNITURE, AND METHODS FOR WEB-STRAPPING FURNITURE

CROSS-REFERENCE TO RELATED APPLICATIONS

This application is a divisional application of, and this application claims priority to, U.S. application Ser. No. 13/296,671, titled "WEB-STRAPPED FURNITURE, WEB-STRAPPING FOR FURNITURE, AND METHODS FOR WEB-STRAPPING FURNITURE," filed on Nov. 15, 2011, (the entire content and disclosures of which are incorporated herein in full by reference as if stated in full herein), which claims priority to U.S. Provisional Application Ser. No. 61/533,686, filed Sep. 12, 2011, entitled "WEB-STRAPPED FURNITURE, WEB-STRAPPING FOR FURNITURE, AND METHODS FOR WEB-STRAPPING FURNITURE," the entire content and disclosures of which are incorporated for all purposes by reference herein as is fully stated herein.

FIELD OF THE INVENTION

The field of the present invention is web-strapped furniture, web-strapping for furniture, and methods for web-strapping furniture.

BACKGROUND OF THE INVENTION

Furniture for indoor and/or outdoor use, such as casual furniture, may comprise a metal frame with a seat and/or back formed from straps that are attached or otherwise secured to the metal frame.

Frames for such chairs may be made of tubular material such as tubular metal, or may be formed of material such as metal with slots in the frames into which straps may be secured.

Straps for such furniture may be made of vinyl or other materials.

There have been various ways for attaching straps to such frames. Some ways to attach straps to metal frames are disclosed, for example, in U.S. Pat. No. 3,114,578 (E. F. Hamilton; "Hamilton") and U.S. Pat. No. 5,445,436 (Glen D. Kemnitz; "Kemnitz"). FIG. 8 of Kemnitz depicts a Kemnitz tabbed end (element number 48 of FIG. 8 of Kemnitz) of a strap (element number 16 of FIG. 8 of Kemnitz) that could be inserted through a slot (element number 80 of FIG. 8 of Kemnitz) of a frame such that the tab (element number 52 of FIG. 8 of Kemnitz) catches and abuts itself against an inner wall (element number 82 of FIG. 8 of Kemnitz) of the chair frame to anchor the end of the strap in the frame. Kemnitz discloses that the strap would then be stretched and wrapped around the frame so that the opposing end of the strap could be similarly fastened to the opposing side of the Kemnitz frame.

FIG. 11 of Kemnitz depicts one of various "external" ways of securing an end of a strap to a frame. As depicted in FIG. 11 of Kemnitz, a fastener, such as a canoe clip (element number 184 of FIG. 11 of Kemnitz), a screw, a Christmas tree clip, or similar fastener, may be used to pierce an end of a strap (element number 172 of FIG. 11 of Kemnitz) and the tubular frame (element number 80' of FIG. 11 of Kemnitz) to which the strap is to be attached. Similar to the above-described Kemnitz tabbed-end method of securing a strap to a frame, FIG. 11 of Kemnitz shows a Kemnitz strap (element number 16' of FIG. 11 of Kemnitz) being wrapped around the tubular frame. As will be understood by someone with ordinary skill in the art, the wrapping of a strap may involve heating the strap to form a close conformance of the strap to the frame and to allow stretching of the strap so that the opposing end can be similarly anchored; cooling of the strap results in the strap condensing in form thereby forming a close fit to the frame.

A way of securing straps to wooden frames has been provided by a manufacturer known as "PIRELLI"—PIRELLI has provided rubber webbing straps and webbing "clips", an exemplary illustration of which is depicted in FIGS. 1-3 hereto. As depicted in FIG. 1 hereto, an exemplary PIRELLI clip 190 comprises a piece of metal with "spurs" or "barbs" 192 that, when the clip is compressed so that one side meets the opposing side, the "spurs" or "barbs" fit into small holes 191 or indentations in the opposing side. As will be understood by someone with ordinary skill in the art, a PIRELLI clip could be fit and compressed over an end 194 of a strap 193, such as a rubber strap, such as illustratively depicted in FIG. 2, so that the PIRELLI clip "spurs" would pierce or anchor the material 195 in the opposing small holes 191 of the clip 190; the end of the PIRELLI clip 190 could then be inserted into a wooden frame slot 196 as depicted in FIG. 3; the opposing end of a rubber strap could be similarly capped with a PIRELLI clip and inserted in a wooden frame slot on an opposing frame element (not shown).

As will be understood by someone with ordinary skill in the art, PIRELLI clips have been used with wooden furniture and with rubber straps. As will be understood by someone with ordinary skill in the art, because of the thickness of vinyl straps, PIRELLI clips would not tend to pierce or anchor vinyl material in opposing PIRELLI holes and would therefore not provide a secure anchor. Further, as depicted in FIGS. 1-3 hereto, the shape of PIRELLI clips would not tend to prevent extraction of a PIRELLI-clipped end of a strap from a channel in a tubular metal frame such as illustratively depicted in, for example, FIG. 5B-C, 6A-D, 13, 14A-B, or 15-18 hereto.

An alternative way of providing strapping for chairs is disclosed in U.S. Pat. No. 5,769,500 (Richard Holbrook; "Holbrook"). Holbrook discloses segments with injection-molded portions on each end of the segment that fit into channels formed in opposing rails of a metal frame. As will be understood by someone with ordinary skill in the art, equipment for injection-molding segments such as disclosed in Holbrook are very expensive, some costing in the range of $100,000. Further, as will be understood by someone with ordinary skill in the art, due to costs involved in injection-molding processes, orders for injection-molded segments as disclosed by Holbrook may involve molding thousands of segments of a single configuration, size and color; small orders or individual orders for a single segment would not be commercially practical. Further, as will be understood by someone with ordinary skill in the art, injection-molded Holbrook segments would be relatively hard and would not easily mold around a frame in which rail channels are disposed in exterior sides of rails or in the back of rails. Rather, FIGS. 2 and 3 of Holbrook disclose Holbrook segments fitting into a "top" or "front" channel of a metal frame; such applications of Holbrook segments do not involve bending a Holbrook segment around a frame rail such as is depicted in, for example, FIGS. 14A-B, 15 and 16 hereto.

As an alternative to chairs with strapping, casual furniture may comprise a "sling" that forms a back and a seat comprising a singular "sling" member. For example, as depicted in FIG. 4 hereto, a singular "sling" member 402 is secured to a metal frame to form a chair back and seat. Such "sling" chairs may comprise a metal frame with opposing members, e.g., frame side rails 401*a* and 401*b* wherein each opposing member (each frame side rail) comprises a channel (see element number 406, FIGS. 5B and 5C) that traverses the length of the member (e.g., elements 401*a* and 401*b*). An exemplary "sling" may comprise a single piece of material 402, such as vinyl mesh material; each side 404 of the single piece of material 402 may be wrapped around a corresponding cord member 403 (sometimes referred to as a "keeper rod") as depicted in FIG. 5A; stitching 419 may be used to fasten the material 402 around the cord ("keeper rod"); each cord-wrapped side is inserted through a corresponding channel 406 in the corresponding frame member 401*a*/401*b* as depicted, e.g., in FIG. 5C.

Sling chairs and sling members may be very expensive. In commercial environments such as large hotels, when a sling member of such chairs is damaged, it may be very expensive to replace the sling member, and even more costly to replace the entire sling chair. Further, as will be understood by someone with ordinary skill in the art, because a "sling" is a single member, insertion of a new "sling" into a sling frame is resource intensive and requires knowledge and skill in order to properly fit a new sling into a sling frame. As will be understood by someone with ordinary skill in the art, sling chair frames may comprise various rail and rail channel configurations. Top plan views of various exemplary sling chair frame and frame rail configurations are depicted in FIGS. 6A through 6D. FIGS. 6A through 6D depict exemplary sling element (602) with exemplary sling chair arms (610) and sling chair seat edge (611) in relation to the various sling chair rail (600, 600', 600", 600'")/channel (603, 603', 603", 603'") configurations. As depicted, sling chair frames may comprise frame rail channels along the chair's front (chair rail channel 603 in front of chair rail 600 as depicted in FIG. 6A), in the exterior sides of the chair rails (chair rail channel 603' in exterior side of chair rail 600' as depicted in FIG. 6B), in the rear of the chair rails (chair rail channel 603" in rear of chair rail 600" as depicted in FIG. 6C), in the interior sides of the chair rails (chair rail channel 603'" in interior side of chair rail 600'" as depicted in FIG. 6D), or in some offset variation.

As will be understood by someone with ordinary skill in the art, exemplary embodiments of the above-mentioned Holbrook segment could be used to replace a sling member if the corresponding sling frame happened to have top/front channels as depicted in FIG. 6A. However, as will be understood by someone with ordinary skill in the art, because of their stiffness, Holbrook segments would not be useable with metal frames comprising rail channels in the frame's outer sides (as depicted in FIG. 6B), in the rear of the frame (as depicted in FIG. 6C), or in the inner sides of the frame (as depicted in FIG. 6D). Further, for the reasons mentioned previously above, using Holbrook segments involve expensive injection molding processes and would not be commercially feasible for use to replace a sling element for an individual chair.

A way is needed to inexpensively provide web-strapping for furniture.

A way is needed to inexpensively convert or retrofit sling furniture to strapped furniture.

SUMMARY OF THE INVENTION

Exemplary embodiments of the present invention would provide web-strapped furniture and methods of web-strapping furniture. In particular, Exemplary embodiments of the present invention would provide web-strapping for upholstery of furniture, methods of providing web-strapping for upholstery of furniture, web-strapped furniture, and methods of web-strapping furniture.

One exemplary embodiment of the present invention would provide an exemplary strap assembly of material for furniture upholstery comprising at least one fastener fastened into each end of the strap such that a tail end of each fastener is secured from extraction from the strap. In one exemplary strap assembly embodiment, fasteners would be fastened in each corner of each end of a strap so that a tail end of each fastener would be secured from extraction from the strap. Other exemplary embodiments would provide an exemplary article of furniture and methods of making an exemplary article of furniture, comprising said strap assemblies installed to span a space between opposing chair rails.

One exemplary embodiment of the present invention would provide, as described further below, an exemplary strap assembly of material for furniture upholstery, said strap assembly comprising: a first fastener fastened into a first end portion of a first end of a first strap, a tail end of said first fastener secured from extraction from said first strap; and a second fastener fastened into a first end portion of a second end of said first strap, a tail end of said second fastener secured from extraction from said first strap.

In one exemplary strap assembly embodiment, said first end portion of said first end of said first strap would comprises a first corner portion of said first end of said first strap, and said first end portion of said second end of said first strap would comprise a first corner portion of said second end of said first strap, said exemplary strap assembly would further comprise: a third fastener fastened into a second corner portion of said first end of said first strap, a tail end of said third fastener secured from extraction from said first strap; and a fourth fastener fastened into a second corner portion of said second end of said first strap, a tail end of said fourth fastener secured from extraction from said first strap.

One exemplary embodiment of the present invention would provide an exemplary article of furniture, and methods for making such an exemplary article of furniture, that would comprise: a first side rail comprising a channel traversing a length of said first side rail; a second side rail comprising a channel traversing a length of said second side rail, said second side rail being separated from said first side rail by a space interval; and a strap comprising two ends, each end of said two ends comprising two corner portions, wherein each end of said two ends comprises a first fastener and a second fastener, wherein each of the first fastener and the second fastener are secured in respective corner portions of said two corner portions, a first end of said strap being slid into the channel of said first side rail, and a second end of said strap being slid into the channel of said second side rail so that said strap spans said space interval between said first side rail and said second side rail.

BRIEF DESCRIPTION OF THE DRAWINGS

These and other features of the present invention are more fully set forth in the following description of exemplary embodiments of the invention. The description is presented with reference to the accompanying drawings in which:

FIG. 5A depicts an illustrative "sling" element side;

FIG. 5B depicts an illustrative "sling" chair rail and channel;

FIG. 5C depicts an illustrative "sling" element side inserted in an illustrative "sling" chair rail channel;

FIG. 19 depicts a perspective view of an alternative exemplary embodiment of a strap end clip clamped around an end of an exemplary strap and with exemplary rivets fastened there through;

DETAILED DESCRIPTION OF THE INVENTION

Figure 1:
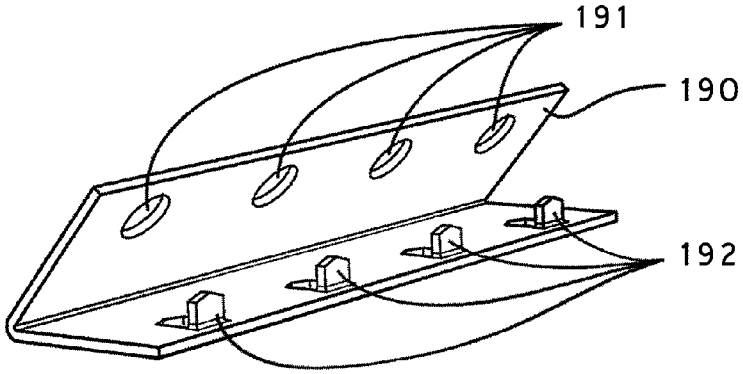
FIG. 1 depicts a PIRELLI clip.
Figure 2:
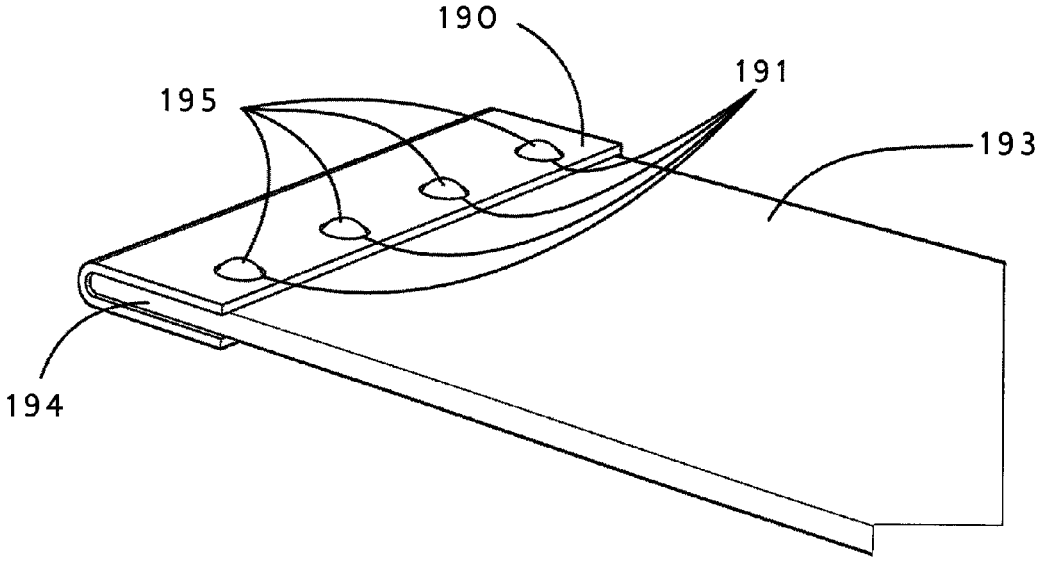
FIG. 2 depicts a PIRELLI clip attached to an end of a strap.
Figure 3:
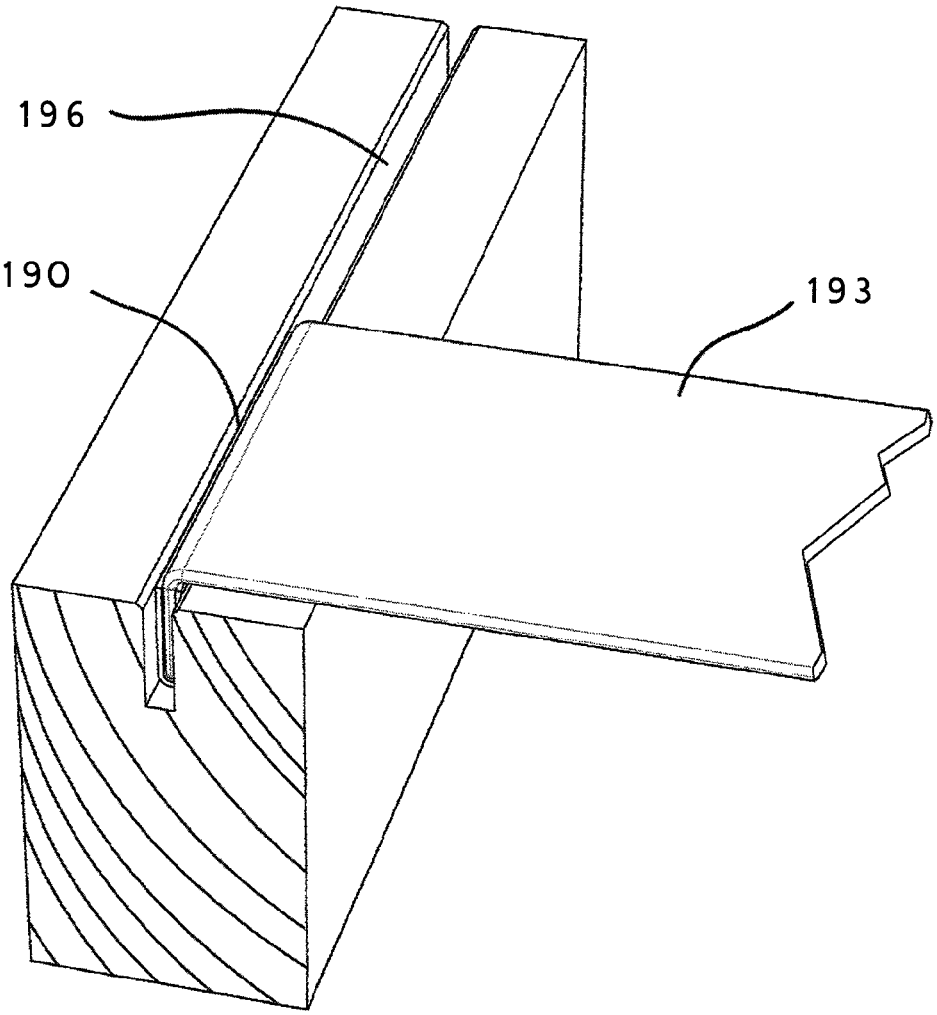
FIG. 3 depicts a PIRELLI-clipped end of a strap inserted into a wooden rail slot.
Figure 4:
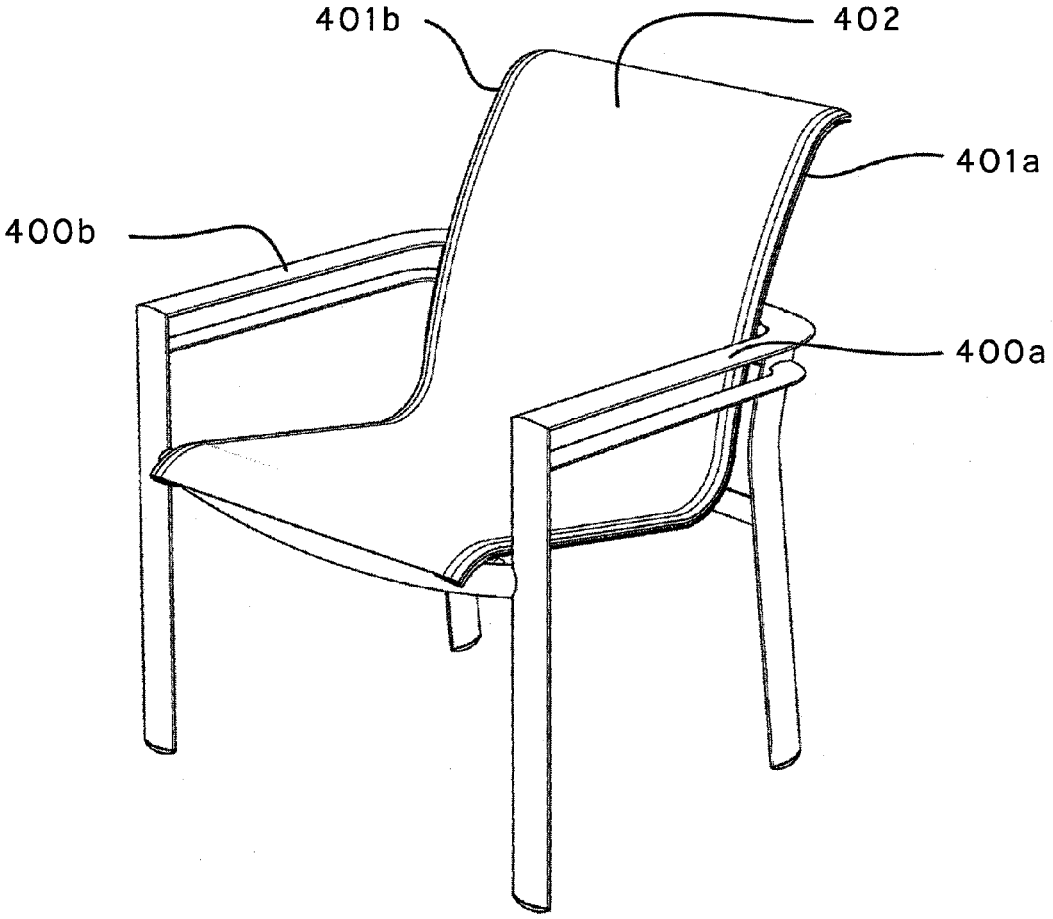
FIG. 4 depicts an illustrative "sling" chair with an exemplary metal frame.
Figure 6A:
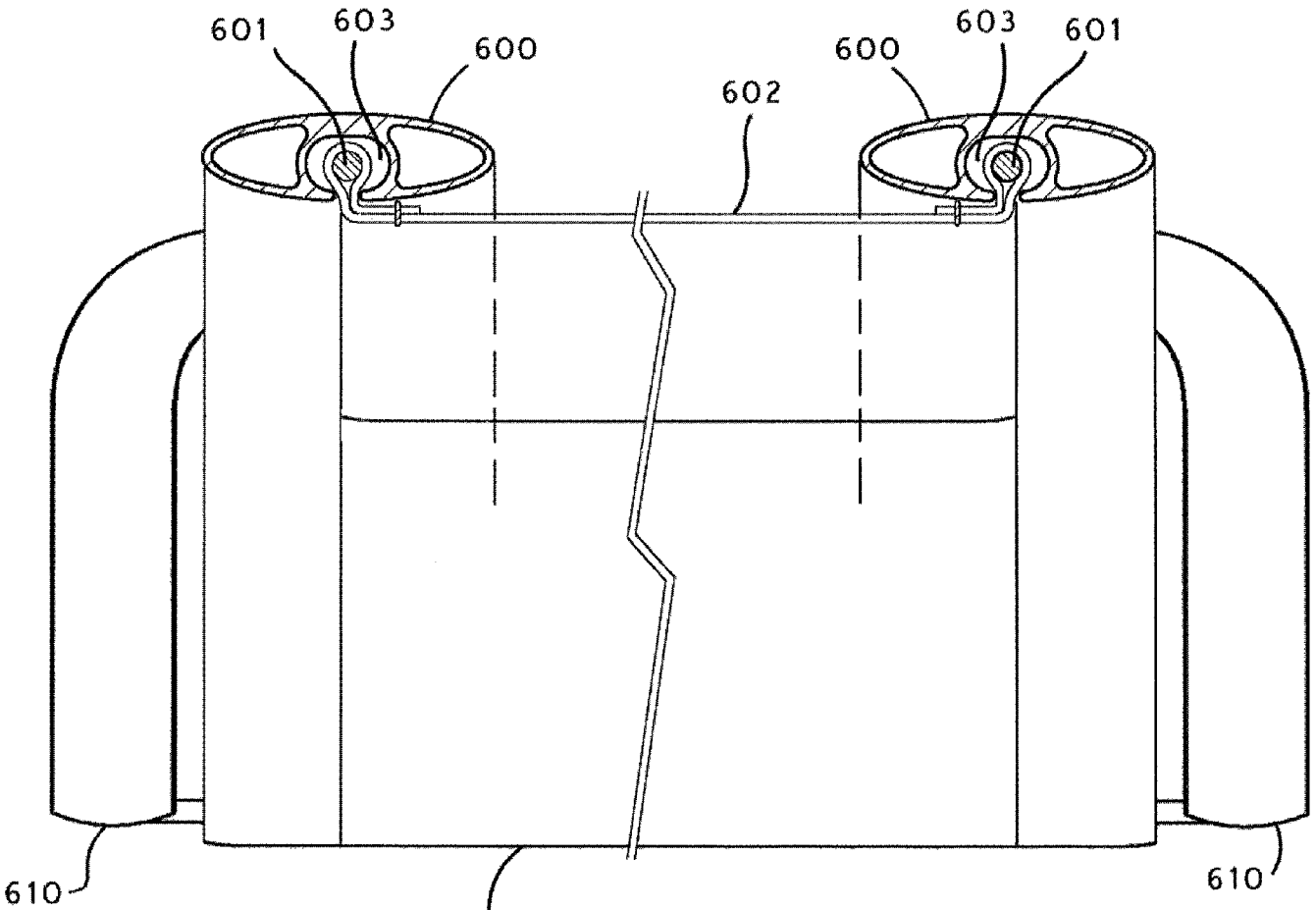
FIGS. 6A through 6D depict illustrative front, exterior side, rear and interior side rail channels respectively.
Figure 6B:
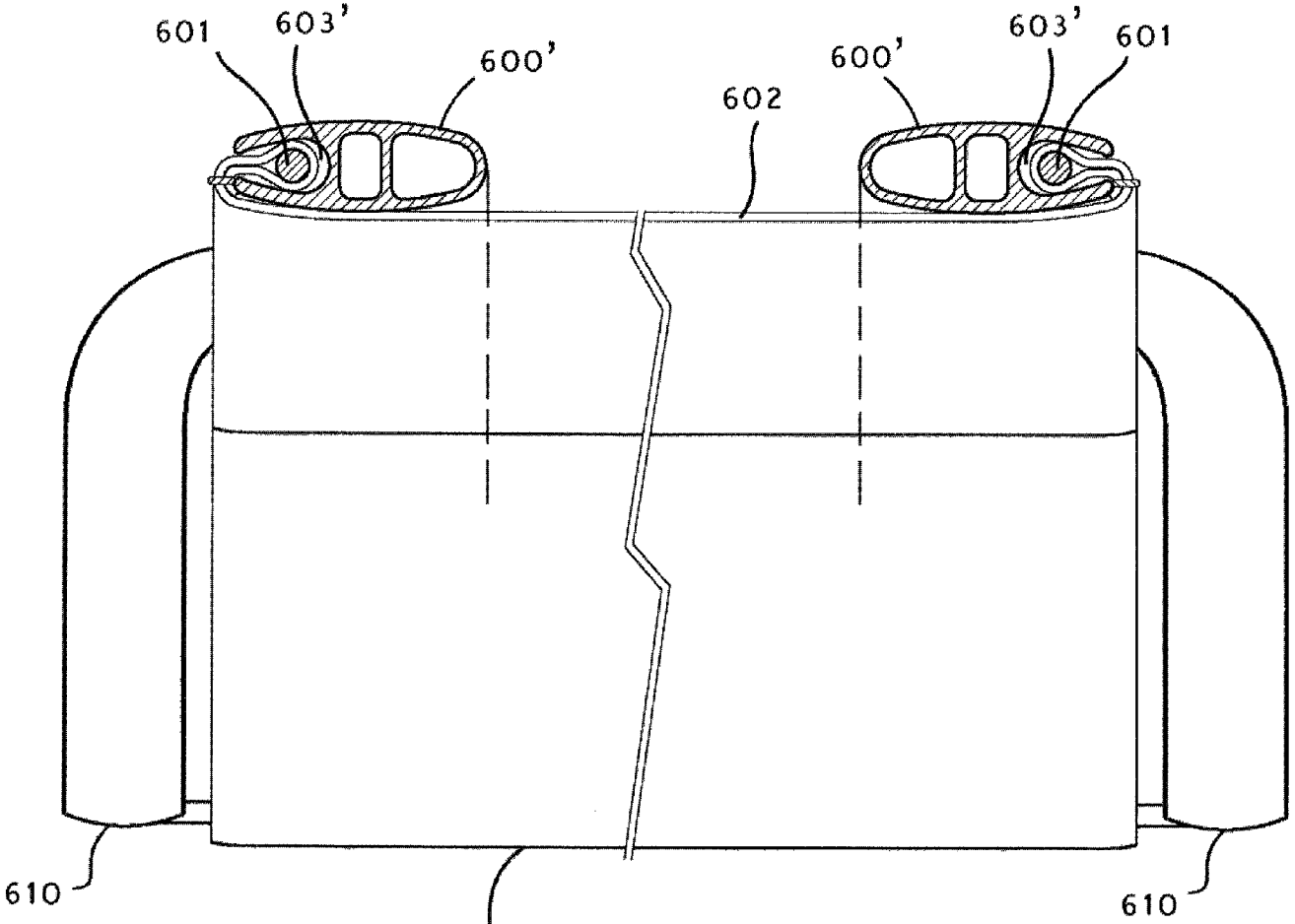
Figure 6C:
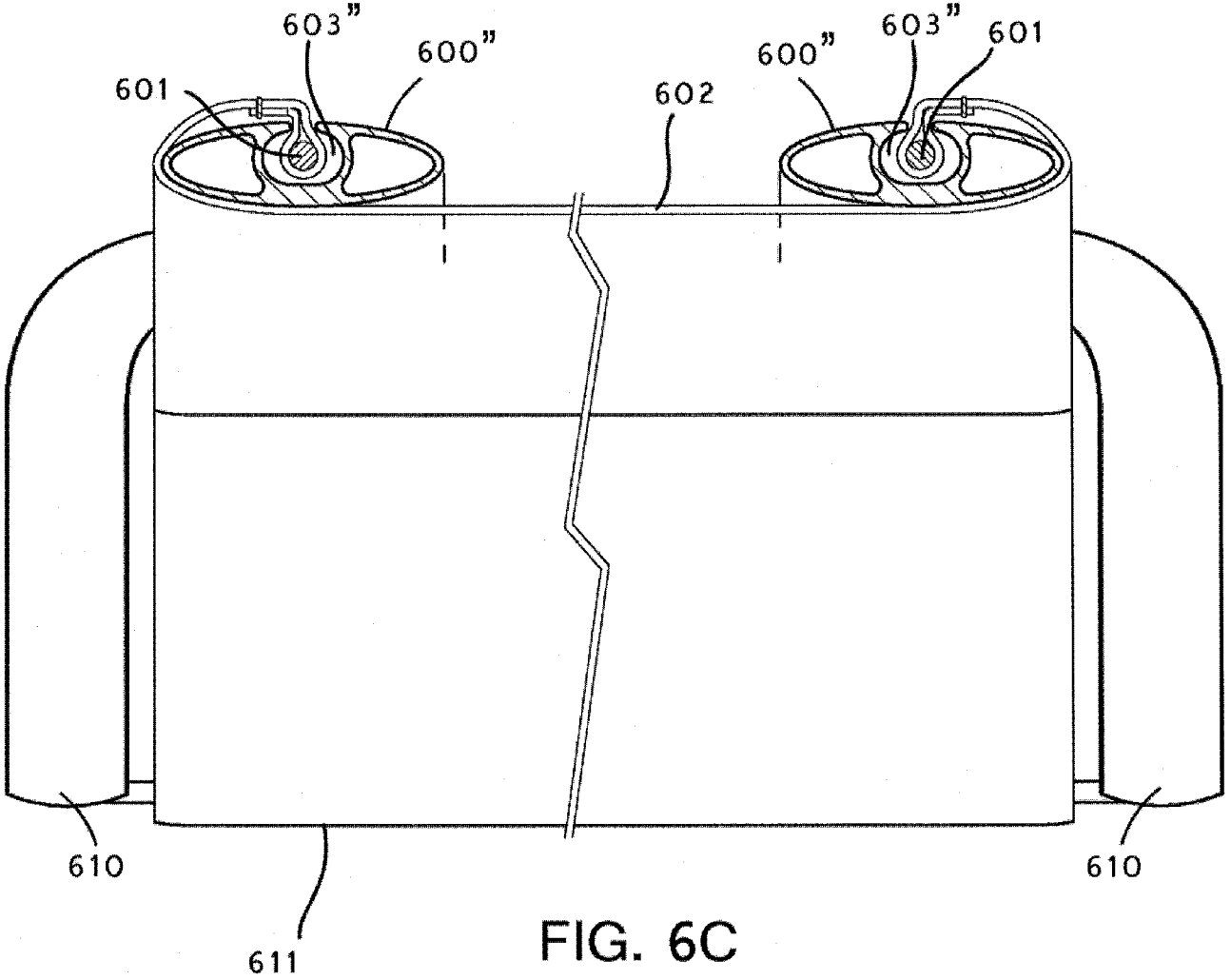
Figure 6D:
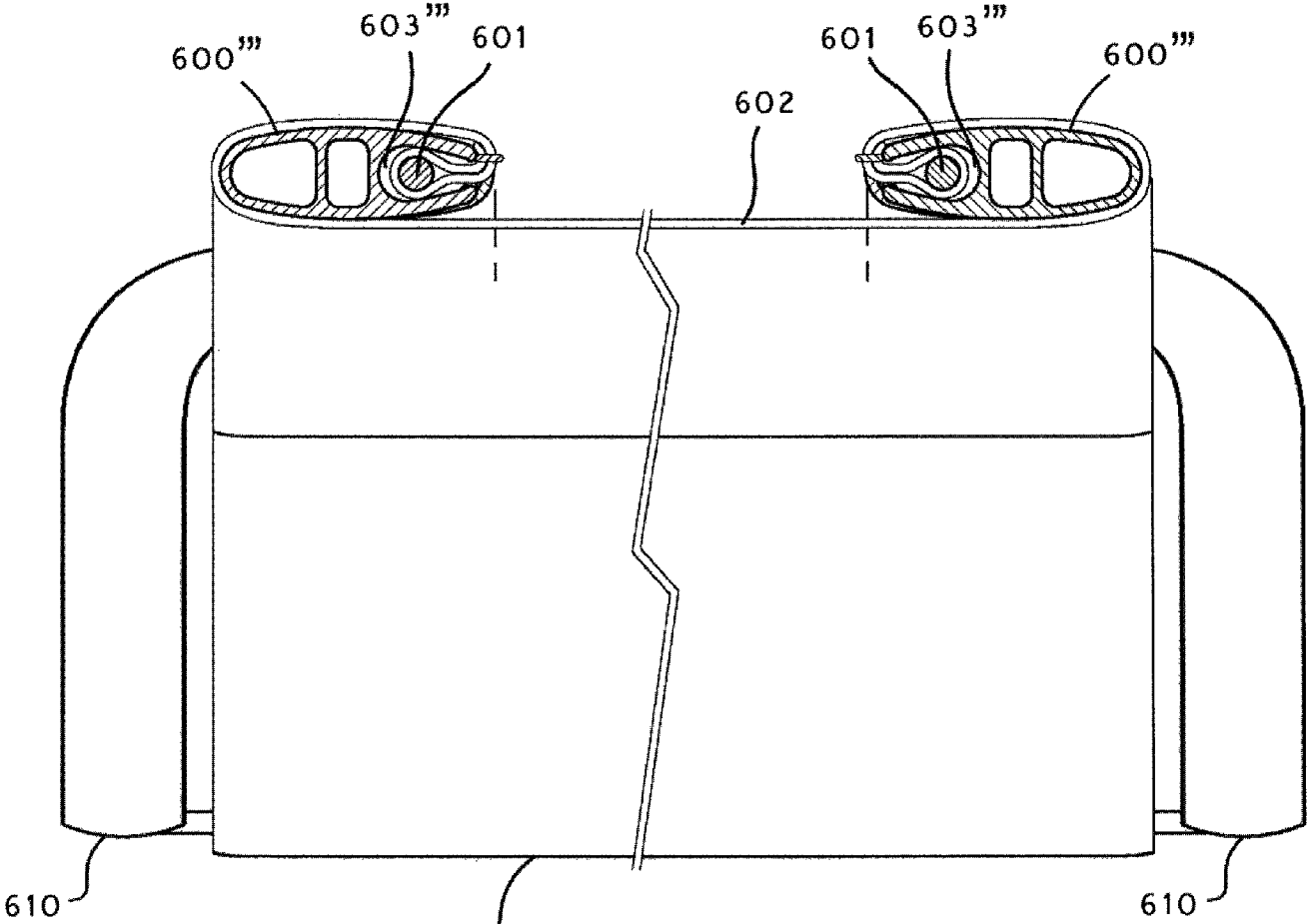
Figure 7:
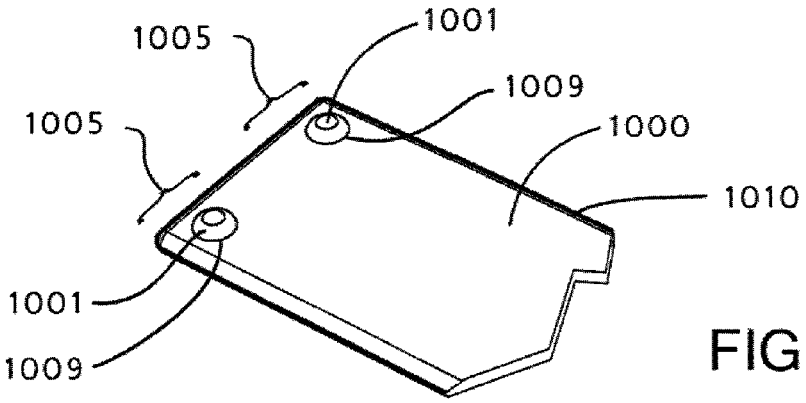
FIGS. 7-12 depict various perspective and plan views of an exemplary end of an exemplary strap that has been riveted and prepared for securing into a sling-rail channel in an exemplary embodiment of the present invention.
Figure 8:
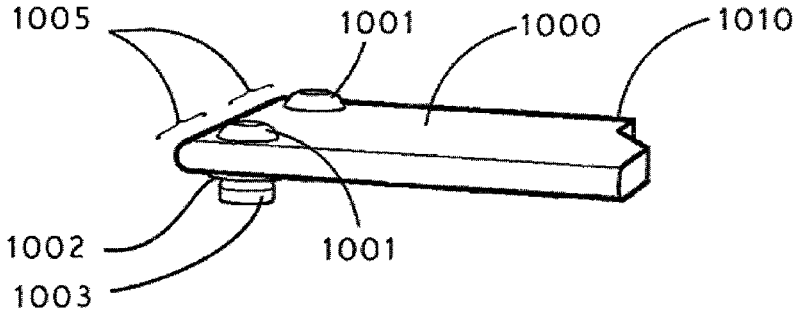
Figure 9:
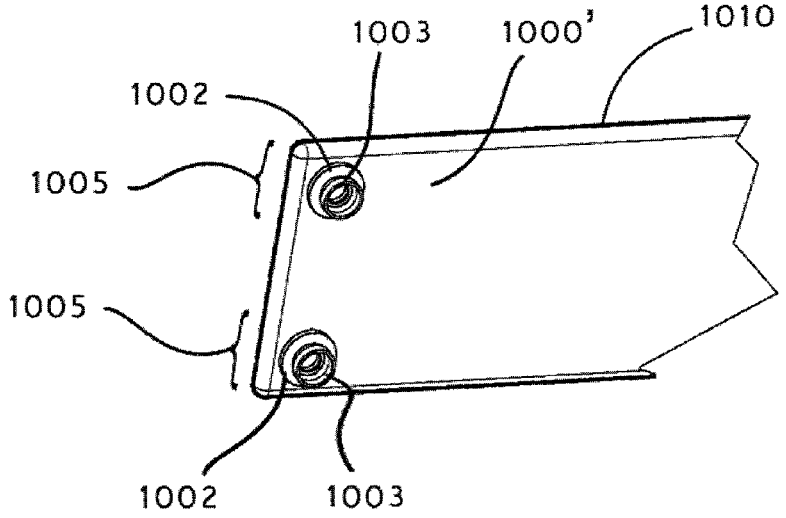

With reference to FIGS. 7-9, exemplary embodiments of the present invention would drive exemplary rivets through an exemplary pre-drilled or pre-punched hole 1009 in exemplary end corner portions 1005 of each end of an exemplary strap 1010.

As will be understood by someone with ordinary skill in the art, in alternative embodiments, instead of pre-drilling or pre-punching holes (1009) in strap end corner portions, it would be possible to drive certain types of fasteners (e.g., sharp-tipped fasteners) through a strap without pre-forming a hole; such embodiments would not depart from the spirit of the present invention.

However, as will be understood by someone with ordinary skill in the art, the fastening of an exemplary rivet as described herein, through a pre-formed hole in a corner portion of a strap end would create a fastening "head" on both sides (the top side 1000 and the underside 1000') of the strap. That is because, as will be understood by someone with ordinary skill in the art, before fastening, a rivet comprises a cylindrical shaft with a head (sometimes referred to as a "factory head") on one end, and what is sometimes referred to on the opposite end as a tail—the tail end is blunt. Installation of a rivet involves placing the cylindrical shaft of the rivet through a punched or pre-drilled hole and then deforming the tail end (sometimes referred to as "upsetting" or "bucking" the tail end). The deformation of the tail end of the rivet expands the diameter of the rivet shaft that is below the riveted material; the deformed end of an installed rivet is sometimes referred to as a "shop head." As a result of the above-mentioned deformation, once installed, the rivet has two heads, namely, the "factory head" that is above the riveted material, and the "shop head" (also sometimes referred to as a "buck-tail") that is formed below the riveted material. Because there is effectively a head on each end of an installed rivet, then when a shear load, (i.e., that is perpendicular, or substantially or relatively perpendicular, to the axis of the shaft of the rivet) is exerted against such an installed rivet that is in a rail channel 603 (see FIG. 15), such as could be caused by the weight of an occupant of the furniture against the strap anchored by the rivet, the two heads of the rivet would move toward the opening 619' (see, e.g., FIGS. 24-26) of the subject channel until the two heads abut against the opening portions 619 of the rail channel 603 (see FIG. 15) and thereby resist extraction from the opening 619' (see, e.g., FIGS. 24-26) of the rail channel, e.g., see 603", FIGS. 24-26. As will be described further below, a strap with rivets installed as described herein is suited to supporting shear loads that would be exerted against the rivets as could be caused by the weight of a person sitting in an article of furniture embodying straps installed according to an exemplary embodiment of the present invention.

In one embodiment, vinyl straps would be used. However, as will be understood by someone with ordinary skill in the art, the present invention is not limited to vinyl straps but rather may be used with straps comprising other materials whether now known or in the future discovered. Further, although exemplary solid straps are depicted in the exemplary drawings, as will be understood by someone with ordinary skill in the art, use of solid straps is not a limitation of the present invention. Rather, perforated straps, mesh material, or other materials, whether now known or in the future discovered, could be used as straps without departing from the spirit of the present invention.

Further, in one exemplary embodiment, stainless steel rivets and washers would be used. However, as will be understood by someone with ordinary skill in the art, the present invention is not limited to rivets of any particular material. Rather, rivets, and other types of fasteners, whether of stainless steel, aluminum, titanium, or other materials whether now known or in the future discovered, could be used without departing from the spirit of the present invention. For example, in some embodiments, it would be possible to use screws with washers, or other types of fasteners.

Once inserted into an exemplary hole 1009 in an exemplary strap 1010, an exemplary head end 1001 of each rivet would rest on a top surface 1000 of the corresponding end corner portion 1005 of the strap 1010. The cylindrical tail end (not shown) of the exemplary rivet would be inserted through the exemplary hole 1009, so that it would protrude through a bottom surface 1000' of the exemplary strap 1010; the rivet would be installed to secure the rivet in strap 1010 by deforming the tai end of the rivet into a "shop head" 1003 of the rivet. That is, exemplary installation of the rivet would involve the deformation of the tail end 1003—a deformed tail "shop head" 1003 of an installed rivet is depicted, for example, in FIGS. 8, 9, 11, 12, 13, 14A, 14B, 15, and 17.

In one embodiment, individual washers 1002 would be used on the underside 1000' of the strap 1010 through which the cylindrical tail end of the rivet would protrude before performing the above-mentioned installation/deformation process to form the deformed tail "shop head" 1003 illustratively depicted in FIGS. 8, 9, 11, 12, 13, 14A, 14B, 15, and 17.

The drawings illustratively depict exemplary use of what are sometimes called "POP" (blind) rivets. However, as will be understood by someone with ordinary skill in the art, there are various types of rivets and other types of fasteners, that could be used without departing from the spirit of the present invention. For example, there are, among others, various types of tubular rivets, semi-tubular rivets, solid rivets and drive rivets that could be used without departing from the spirit of the present invention.

As will be understood by someone with ordinary skill in the art, straps of various widths could be used with the present invention. For example, for a single article of furniture, straps of various widths and colors could be used to provide a particular design, such as, for example, alternating widths and colors. For wider straps, in addition to fastening rivets in each corner portion 1005, additional rivets could be placed in between the corner-portion rivets as illustratively depicted in FIG. 10. For narrower straps (not shown), it would be possible to fasten a single rivet (or other fastener) in each end of the strap, such as at an approximate middle of the strap width.

It will be understood by someone with ordinary skill in the art that the description herein of a "width" of a strap will refer to what is sometimes called the "height" of a strap—that is, reference herein to the "width" of a strap shall not refer to the distance between two opposing rails of an item of furniture; rather, the term "width" of a strap shall be understood to refer to the height of the strap from one edge along the length of the strap to the opposing edge along the length of the strap.

Figure 11:
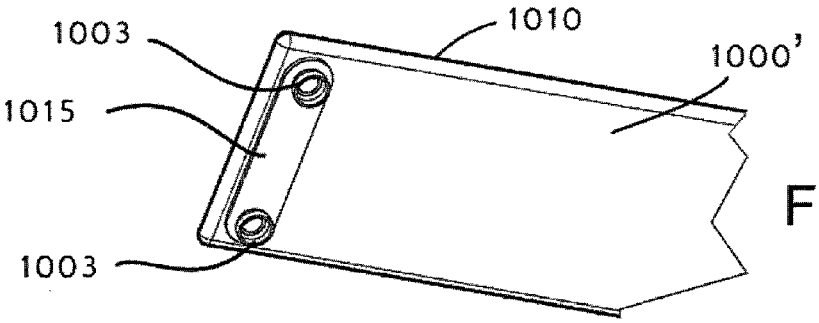

In an alternative exemplary embodiment, as illustratively depicted in FIG. 11, an exemplary washer strip 1015 would be used on the underside 1000' of the strap 1010 through which the cylindrical tail ends 1003 of the rivets would protrude before deformation of the tail ends 1003 of the rivets.

In a further alternative exemplary embodiment, both an exemplary strip 1015' (which could be either a metal washer strip or a reinforcing strip of material, such as material similar to the strap 1010) and exemplary washers 1002 would be used. In such a further alternative exemplary embodiment, the exemplary strip 1015' could be made of vinyl or other material similar to the strap 1010.

Figure 19:
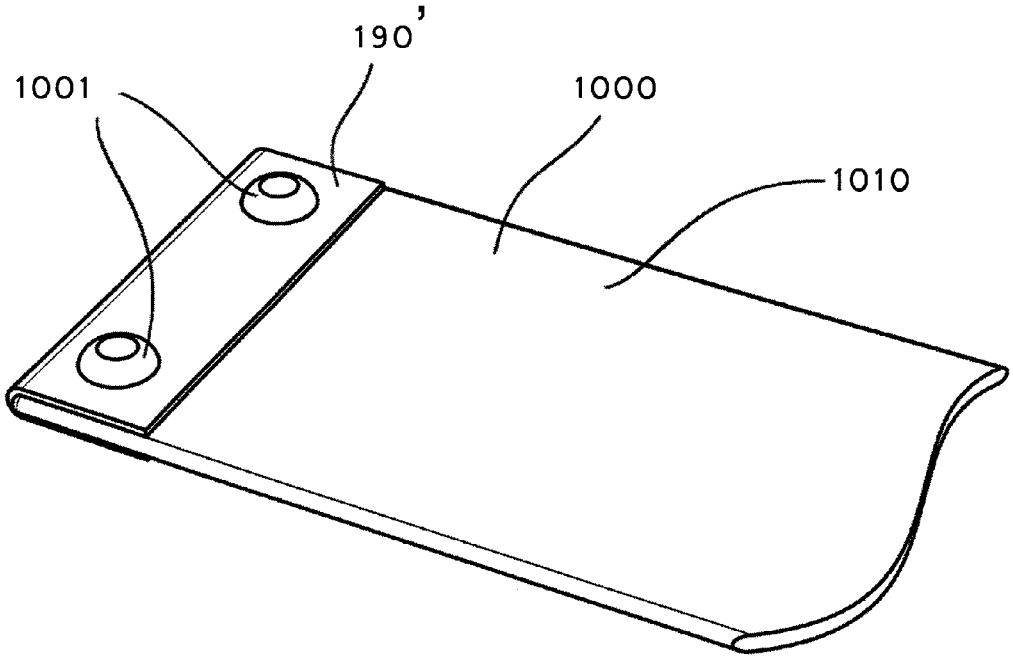

In yet a further alternative exemplary embodiment, rivets (as can be seen as rivet heads 1001) could be inserted through holes (not shown) in an exemplary clip 190' that had been clamped over an end of a strap 1010 as depicted in FIG. 19.

Figure 10:
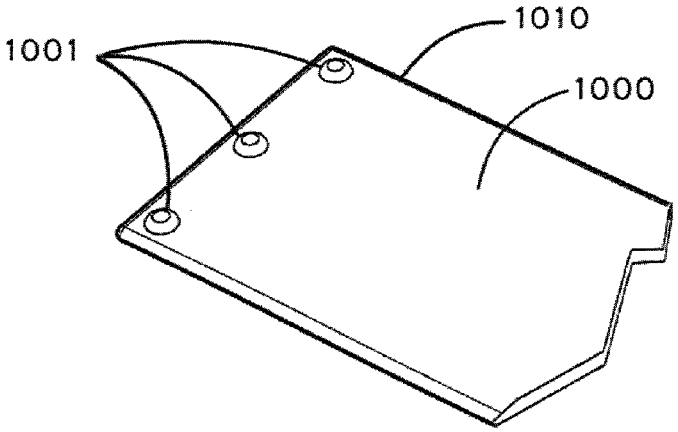
Figure 12:
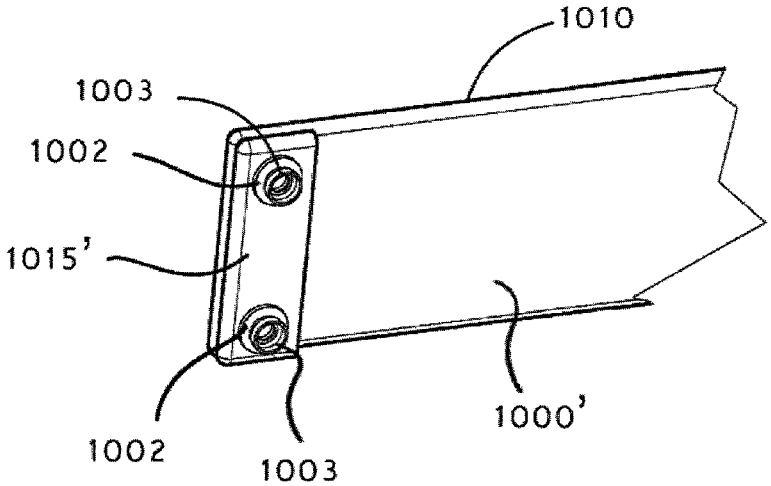

As will be understood by someone with ordinary skill in the art, alternative embodiments such as illustratively depicted in FIGS. 11, 12 and 19, would require exemplary washer strips 1015 (FIG. 11), exemplary reinforcing strips 1015' (FIG. 12) or exemplary clips 190' (FIG. 19) of predetermined length that would match, or be closely dimensioned with, the width of a strap 1010 on which the respective strips or clips are to be fastened; whereas the independent fastening of rivets (or other types of fasteners) in the strap end corner portions 1005 as depicted, for example, in FIGS. 7, 8, and 9 would be independent of the width of any particular strip; additional rivets could be applied in between the strap corner portions for wider strips as depicted illustratively in FIG. 10.

As will be understood by someone with ordinary skill in the art, the independent fastening of rivets (or other types of fasteners) in strap end corner portions 1005 as depicted, for example, in FIGS. 7, 8, 9 and 10 would not require alignment with any washer strip, reinforcement strip or clip holes.

Figure 18:
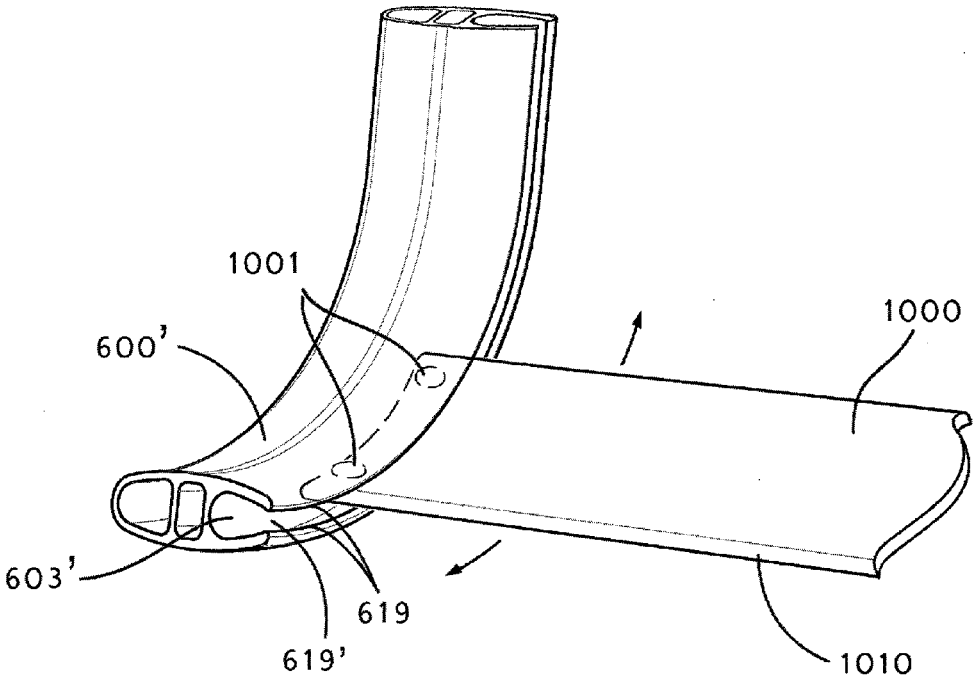
FIG. 18 depicts a perspective view of a back-to-seat transition radius of an exemplary sling chair rail and depicts an exemplary end of a strap with an exemplary embodiment of a strap end fastening in an exemplary embodiment of the present invention being slid through the sling chair rail back-to-seat transition radius.

Yet further, as will be understood by someone with ordinary skill in the art, the independent fastening of rivets (or other types of fasteners) in strap end corner portions 1005 as depicted, for example, in FIGS. 7, 8, and 9, and including embodiments involving additional intermediate rivets as depicted in FIG. 10, would allow the end of the strap 1010 to flex through a channel at a back-to-seat transition rail radius as depicted in FIG. 18; whereas embodiments involving strap-end washer strips 1015 (FIG. 11), reinforcing strips 1015' (FIG. 12) or clips 190' (FIG. 19) could, depending on the material used for such a washer strip 1015 (FIG. 11), reinforcing strip 1015' (FIG. 12) or clip 190' (FIG. 19), be stiff such that it would not be flexible enough to get around a back-to-seat transition rail corner or radius such as for a sling chair frame. As will be understood by someone with ordinary skill in the art, the flexibility of strap ends in independent rivet fastening embodiments as depicted in FIGS. 7, 8, 9 and 10 would be beneficial in retrofitting a sling chair with straps as described further below.

In some embodiments, relatively flexible material, such as, for example, vinyl, could be used to provide an exemplary strip such as exemplary reinforcing strip 1015' (FIG. 12). In such an embodiment, the flexible material strip would flex around a transitional rail corner of a sling chair frame. The description of an exemplary use of vinyl as a reinforcing strip 1015' (and for 1015") is illustrative and not a limitation of the present invention; other materials whether now known or in the future discovered could be used without departing from the spirit of the present invention.

Figure 21:
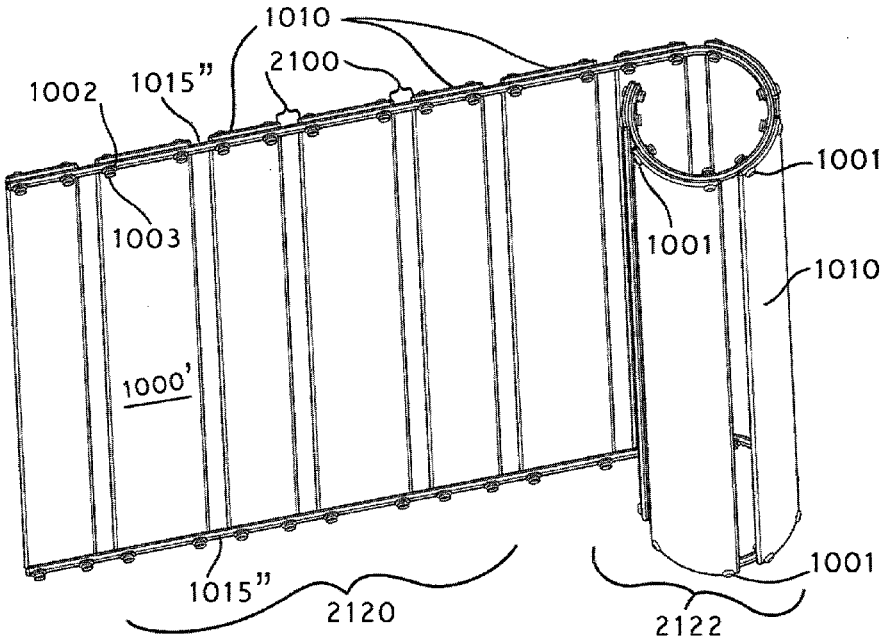
FIGS. 21 and 22 depict perspective views of exemplary multiple-strap web-strapping assemblies in an exemplary embodiment of the present invention.
Figure 22:
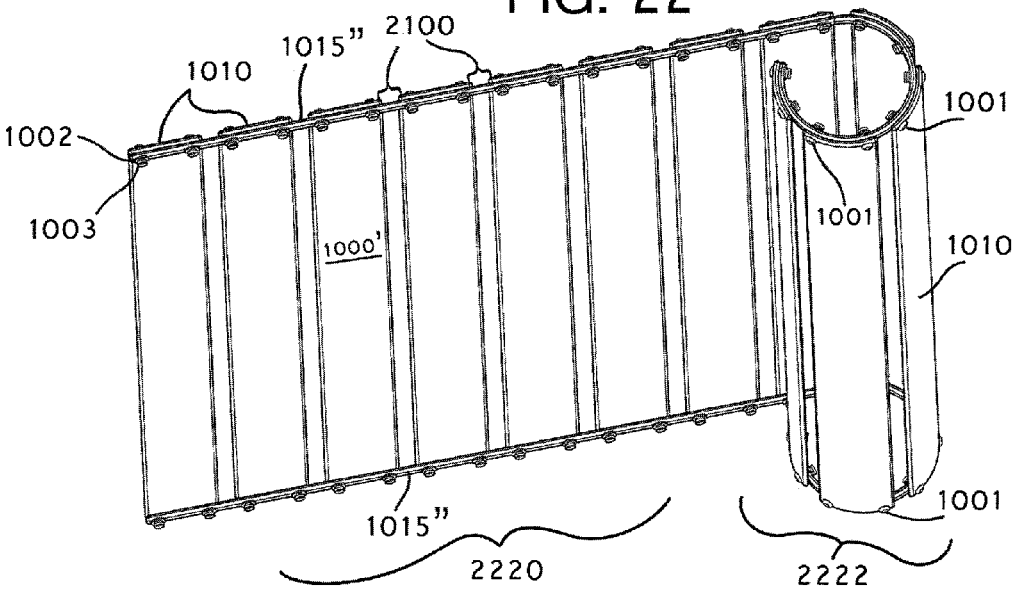

FIGS. 21 and 22 depict exemplary multiple-strap web-strapping assemblies 2120 and 2220 respectively, of multiple straps 1010 where each strap 1010 is fastened at their respective ends with rivets to an exemplary continuous reinforcing strip 1015". Exemplary multiple-strap web-strapping assembly 2120 depicted in FIG. 21 comprises exemplary straps 1010 of varying widths fastened at each end to exemplary continuous reinforcing strips 1015" using exemplary strap end/fastener assemblies (as illustratively depicted as exemplary rivet heads 1001, exemplary rivet "shop heads" 1003 and (optionally) exemplary washers 1002).

Exemplary multiple-strap web-strapping assembly 2220 depicted in FIG. 22 comprises exemplary straps 1010 each having the same strap width; the ends of each strap 1010 being fastened to exemplary continuous reinforcing strips 1015" using exemplary fasteners (as illustratively depicted as exemplary rivet heads 1001, exemplary rivet "shop heads" 1003 and (optionally) exemplary washers 1002).

Figure 24:
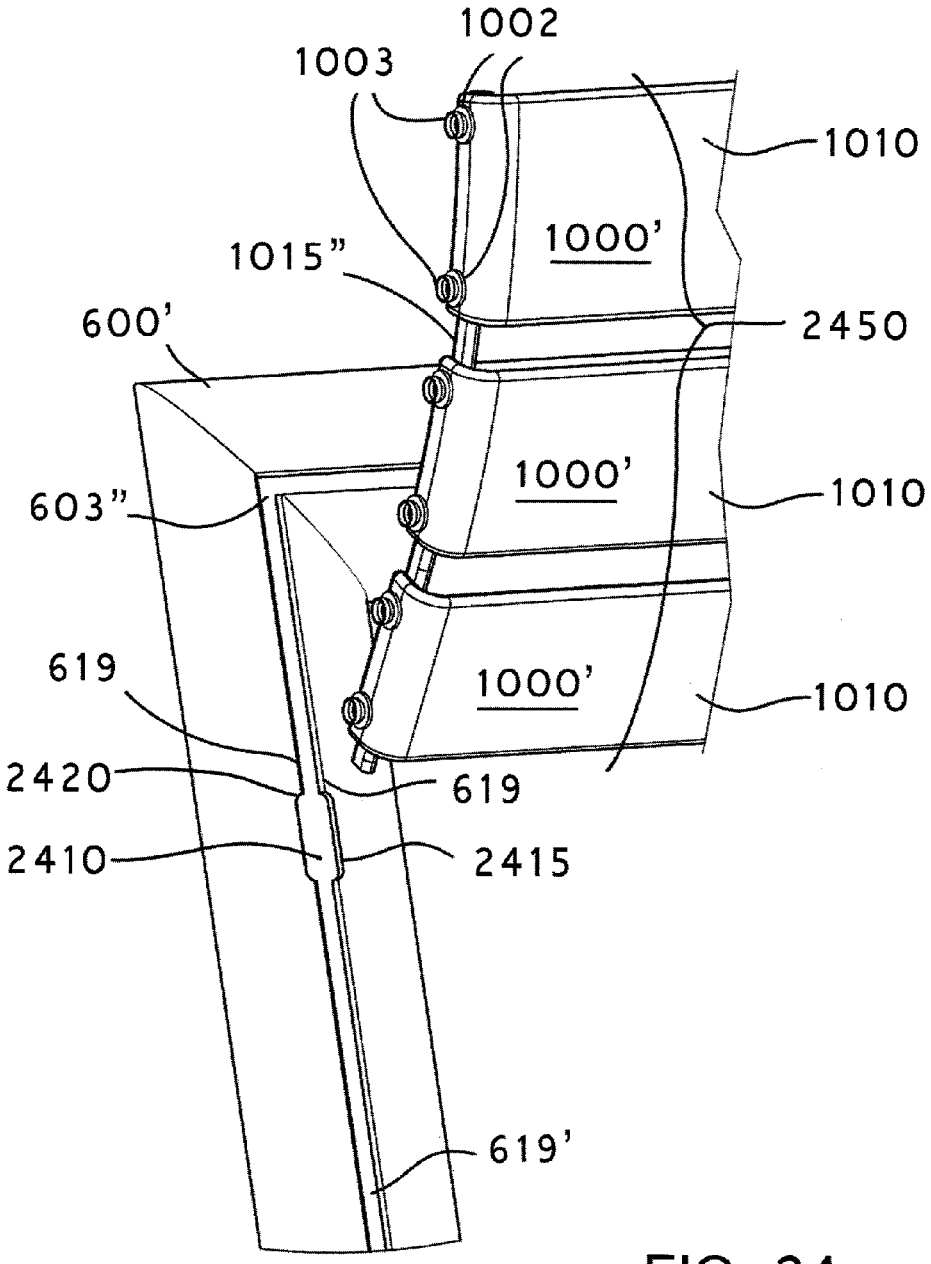
FIGS. 24-26 depict perspective views of exemplary multiple-strap web-strapping assemblies positioned for insertion into an exemplary web-strapping installation port in an exemplary chair side rail in an exemplary embodiment of the present invention.

In the exemplary embodiments depicted in FIGS. 21 and 22, exemplary continuous reinforcing strips 1015" would comprise continuous strips of material that would be fastened to the underneath side 1000' of exemplary straps 1010 by exemplary fastener assemblies (as illustratively depicted as exemplary rivet heads 1001, exemplary rivet "shop heads" 1003 and (optionally) exemplary washers 1002). However, an underneath-strap location for exemplary continuous reinforcing strips 1015" is not a limitation of the invention. Rather, in other exemplary embodiments, such as depicted in FIG. 24, exemplary continuous reinforcing strips 1015" would be fastened to the top side of exemplary straps 1010 by exemplary rivet assemblies (as illustratively depicted as exemplary rivet "shop heads" 1003 and (optionally) exemplary washers 1002).

In yet further alternative exemplary embodiments (not shown), rather than fastening an exemplary continuous strip with exemplary rivets to exemplary straps, the exemplary continuous strip would be fastened to the straps (either to the underside or to the top side of the straps) by other fastening approaches, such as with heat-bonding, stitches, glue, or other fastening devices, chemicals or other means, whether now known or in the future discovered. In such an embodiment where exemplary continuous strips are fastened to exemplary straps using fastening approaches other than the rivets or other fasteners that are to be lodged in an exemplary rail channel, the exemplary continuous strips would not reinforce the fastening of the rivets or other fasteners to the ends of the straps, but would facilitate spacing straps from each other, and would facilitate creating rollable lengths of straps, or rolls of straps, so attached to such exemplary continuous strips. In such an embodiment, the exemplary continuous strips would not necessarily be lodged inside a rail channel when the rivet-fastened ends of straps attached to such exemplary continuous strips are inserted into the rail channel. In some such embodiments, such as in embodiments where there is no space interval between straps, the exemplary continuous strips could be removed once a roll of straps is installed for a particular item of furniture.

In the exemplary embodiments depicted in FIGS. 21 and 22, an exemplary space interval 2100 is depicted between each strip 1010. Exemplary space intervals 2100 between exemplary straps could vary in size from zero (i.e., the straps would be next to each other), to, for example, an inch or less. The description of an inch or less as an exemplary measurement of an exemplary space interval 2100 is illustrative and is not a limitation of the invention.

As depicted in FIGS. 21 and 22, exemplary continuous reinforcing strips 1015" could be used in some exemplary embodiments to separate each strap 1010 from neighboring straps by an exemplary space interval 2100. Exemplary continuous reinforcing strips 1015" comprising a flexible material would facilitate a rolling, such as depicted by exemplary rolled assembly portions 2122 and 2222 of a length of exemplary assemblies, e.g., 2120 and 2220 respectively.

Figure 23:
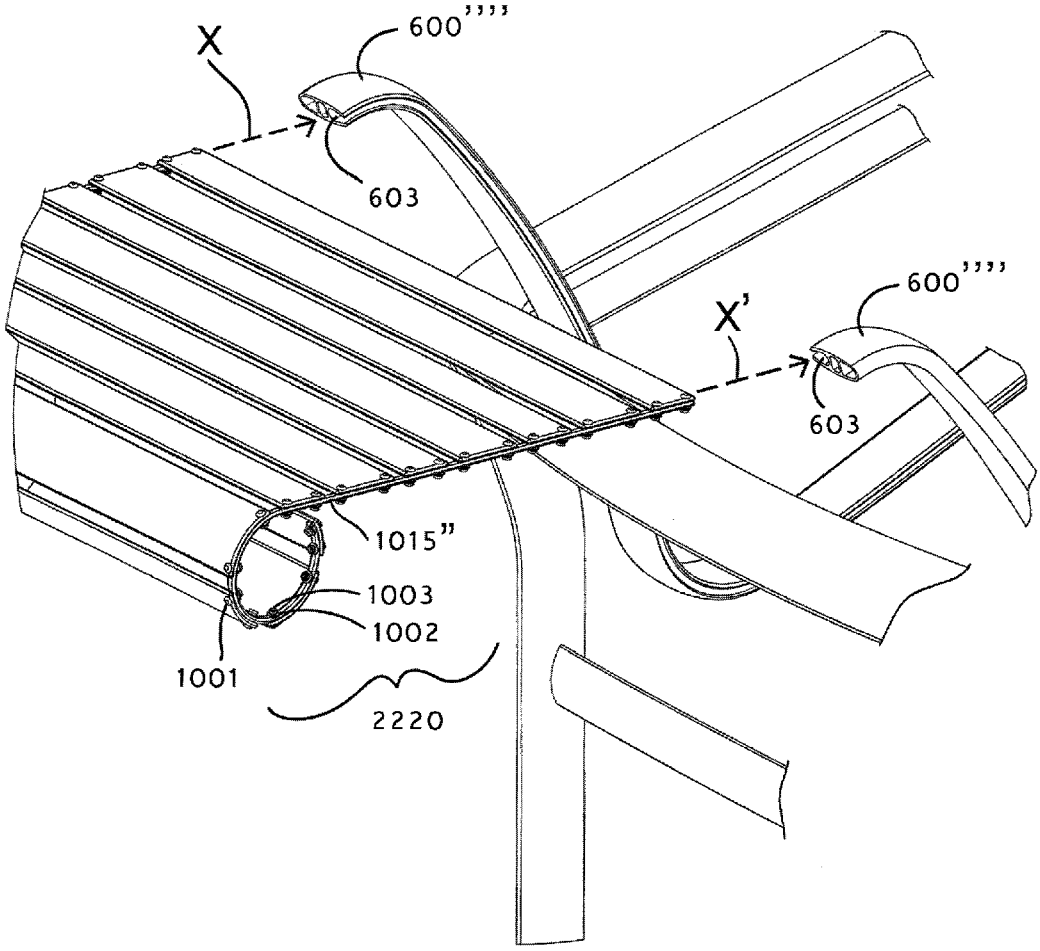
FIG. 23 depicts a perspective view of an exemplary multiple-strap web-strapping assembly positioned for insertion into open-ended channels of exemplary chair side rails in an exemplary embodiment of the present invention.

FIG. 23 depicts an exemplary multiple-strap web-strapping assembly 2220 positioned for exemplary insertion (along exemplary directional lines X and X') into exemplary sling rail chair rail channels 603 in exemplary interior-side-channel chair rails 600"".

The exemplary chair rails 600"" depicted in FIG. 23 are open-ended; because they are open-ended, exemplary web-strapping assembly 2220 can be inserted into exemplary sling rail chair rail channels 603 from the top, or upper-most position, of the channel 603 openings as depicted by exemplary directional lines X and X'. However, as will be understood by someone with ordinary skill in the art, some types of channel-railed furniture may be closed-ended, such as depicted in FIG. 24. The chair rails 600' depicted in FIG. 24, and those depicted in FIGS. 25 and 26 are not open-ended.

In order to facilitate installation of exemplary web-strapping assemblies, e.g., 2120, 2220, exemplary web-strapping assembly installation ports 2410 are illustratively depicted at one or more positions in each rail portion. As illustratively depicted in FIG. 24, an exemplary web-strapping assembly installation port 2410 would comprise exemplary indentations 2415 and 2420 in exemplary opening portions 619 of the rail channel 603".

Figure 25:
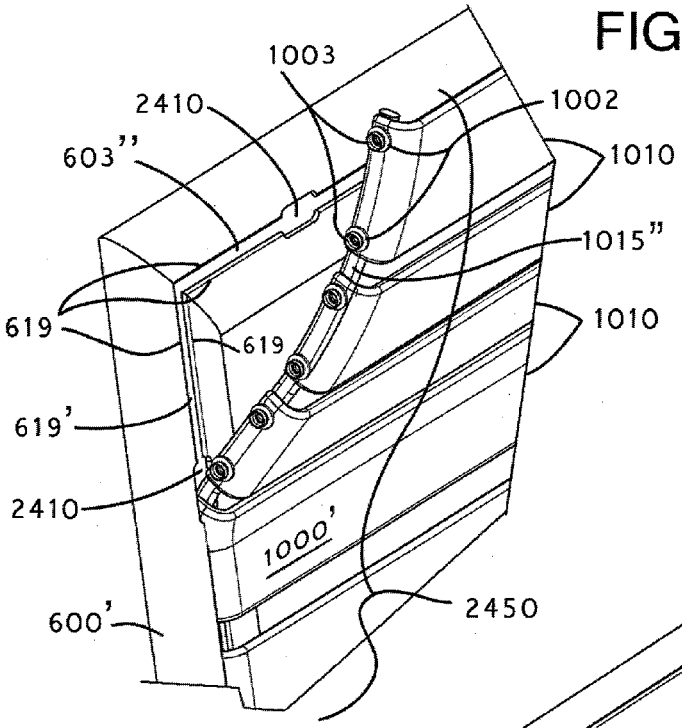
Figure 26:
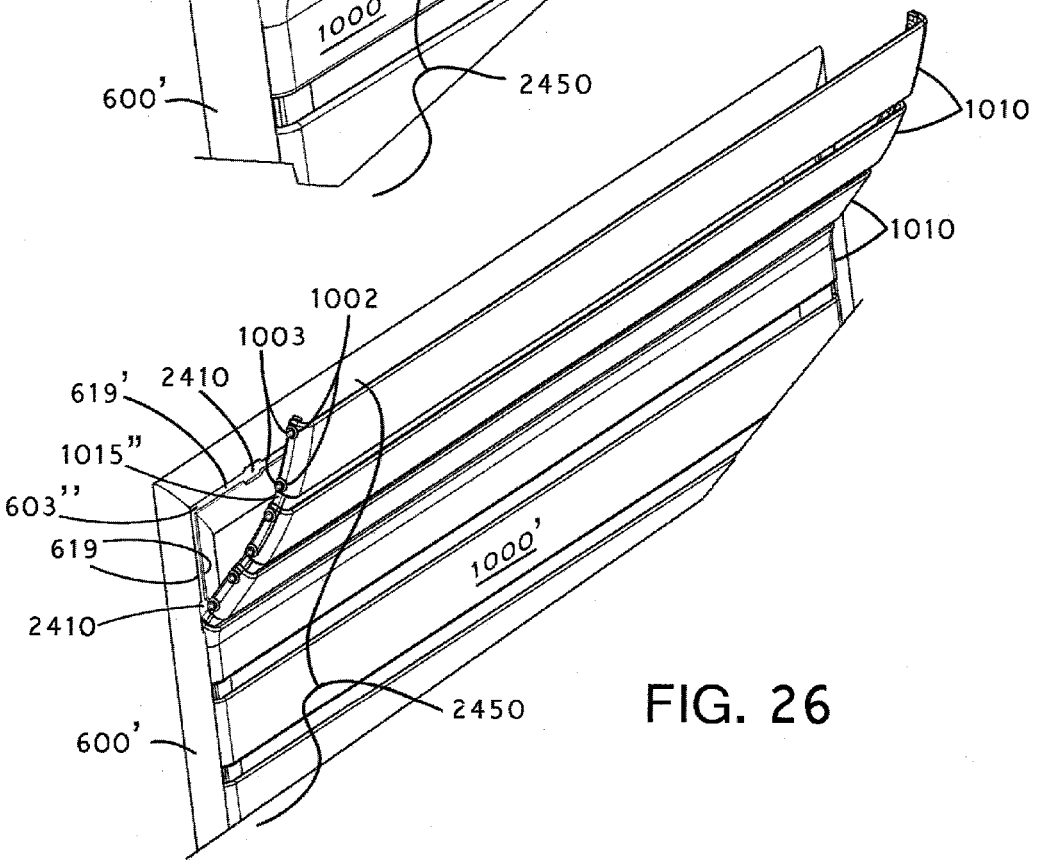

As will be understood by someone with ordinary skill in the art, an exemplary chair rail channel, e.g., 603" as depicted in FIGS. 24-26, may be visible through a narrow opening, depicted as exemplary opening 619', between exemplary channel opening portions 619.

In some exemplary embodiments, as depicted in FIG. 24, exemplary indentations 2415 and 2420 in exemplary opening portions 619 of an exemplary chair rail opening 619' in an exemplary chair rail channel 603" would be of the same length. In other exemplary embodiments, exemplary indentations 2415 and 2420 in exemplary opening portions 619 would have different lengths (e.g., one would be longer than the other).

Exemplary indentations 2415 and 2420 in exemplary opening portions 619 as illustratively depicted in FIG. 24 would provide an exemplary web-strapping assembly installation port 2410 (see FIGS. 24-26) of sufficient size (width and length) to accept insertion of an exemplary side 2450, including exemplary continuous reinforcing strip 1015" and exemplary strap-end/fastener assemblies (as illustratively depicted as exemplary rivet "shop heads" 1003 and (optionally) exemplary washers 1002) of an exemplary web-strapping assembly, e.g., 2120, 2220.

In some exemplary embodiments of exemplary web-strapping assembly installation ports 2410 (see FIGS. 24-26), exemplary port plugs (not shown) could be inserted into exemplary web-strapping assembly installation ports 2410 after installation of exemplary strap-end/fastener assemblies. Such exemplary port plugs could comprise a stopper made, for example, of rubber, that would accept insertion in the port opening but would resist, unless deformed, removal from the port.

Figure 13:
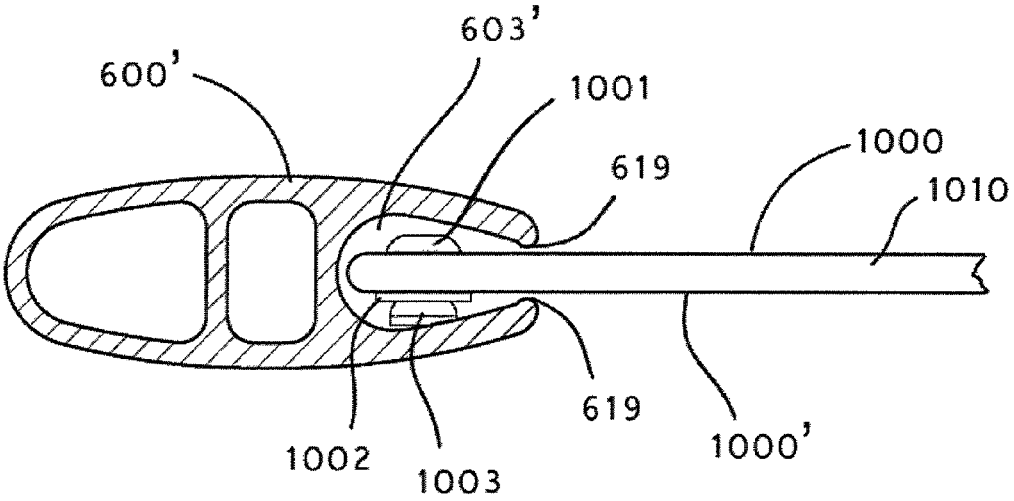
FIGS. 13, 14A-B and 15 depict top plan views of various railing and channel configurations into which an exemplary embodiment of an end of an exemplary riveted strap has been slid into an exemplary channel.

FIG. 13 depicts a top plan view of an exterior side channel railing 600' into which an exemplary embodiment of an end of an exemplary riveted strap has been slid into channel 603'. As depicted in FIG. 13, the head end 1001 and the tail end 1003 of the respective rivets (only one is visible in FIG. 13, because the second rivet is below the first in channel 603') interfere against removal of the strap end from channel 603'.

Figure 14A:
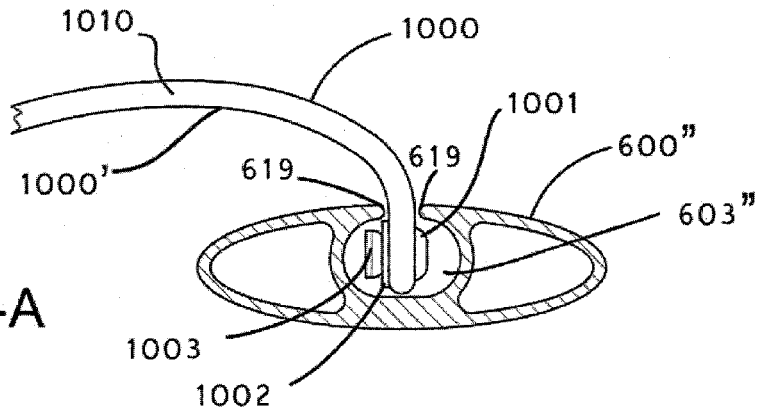
Figure 14B:
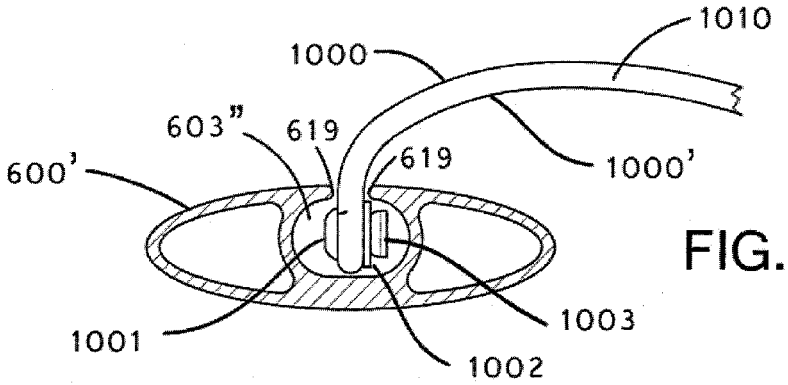
Figure 15:
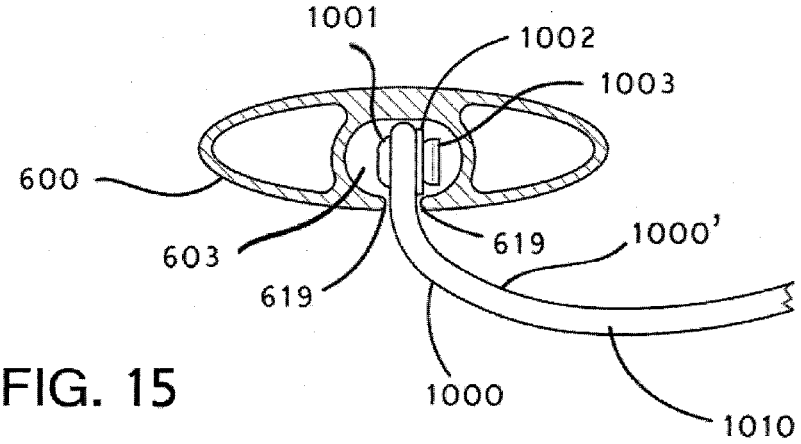

FIGS. 14A and 14B are top plan views of opposing rear channel railings 600" into which exemplary embodiments of ends of an exemplary riveted strap has been inserted in channel 603". FIG. 15 depicts a top plan view of a front channel railing 600 into which an exemplary embodiment of an end of an exemplary riveted strap has been inserted in channel 603.

As depicted in FIGS. 13, 14A-B and 15, in each case, the head end 1001 and the tail end 1003 of the respective rivets (only one is visible in each of FIGS. 13, 14A-B, and 15 because the second rivet is below the first in the depicted channels 603', 603" and 603 respectively) interfere against removal of the strap end from channel 603' through rail opening 619.

Figure 20:
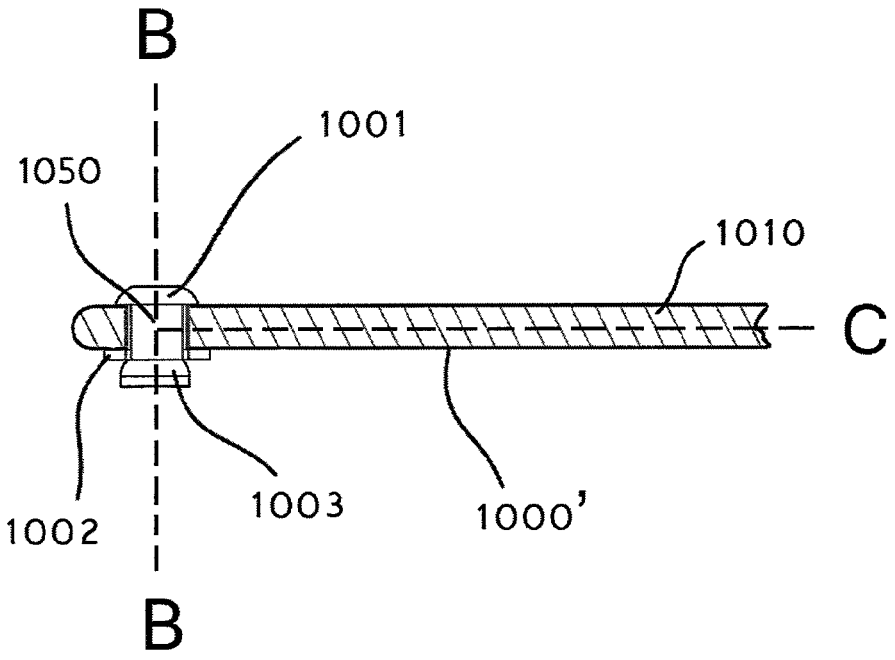
FIG. 20 depicts a cut-away side view of an exemplary rivet fastened in an exemplary strap in an exemplary embodiment of the present invention.

As will be understood by someone with ordinary skill in the art, the exemplary rail opening 619 depicted illustratively in FIGS. 13, 14A-B and 15 would suspend the fastened strap material of the riveted strap 1010 at a substantially, or relatively, perpendicular angle as depicted in FIG. 20 as line "C" with respect to an axis (depicted as line B-B in FIG. 20) of the shaft (illustratively depicted as element 1050 in FIG. 20) of the depicted rivet (depicted in FIGS. 13, 14A-B and 15 as rivet head 1001 and rivet shop head/tail end 1003).

As will be understood by someone with ordinary skill in the art, the rivets would be capable of supporting a shear force (such as is illustratively depicted by exemplary line "C" in FIG. 20) that is exerted perpendicular (substantially or relatively perpendicular) to an axis (depicted as line B-B in FIG. 20) of the shaft 1050 of the rivet, such as may be exerted on a strap 1010 that is secured in a channel (e.g., exemplary channel 603' depicted in FIG. 13; exemplary channel 603" depicted in FIGS. 14A and 14B; and exemplary channel 603 depicted in FIG. 15) by a body of an occupant of the article of furniture. In particular, as was previously mentioned above, there is effectively a head on each end of an installed rivet. Therefore, when a shear load, such as is illustratively depicted by exemplary line "C" in FIG. 20, i.e., that is perpendicular, or substantially or relatively perpendicular, to the axis (depicted as line B-B in FIG. 20) of the shaft 1050 of the rivet is exerted, such as could be caused by the weight of an occupant of the article of furniture against a strap anchored by such rivet in a rail channel rail channel 603 (see FIG. 15), the two heads of the rivet would move toward the opening 619 of the rail channel (e.g., 603 in FIG. 15) until the two heads abut against the opening portions 619 of the rail channel 603 (see FIG. 15) and thereby resist extraction from the opening (see, e.g., element 619' depicted in FIG. 24) between opening portions 619 of the rail channel 603.

As will be further understood by someone with ordinary skill in the art, rail opening 619' (see, e.g., FIG. 18) would be sufficiently large to allow straps 1010 with riveted ends in rail channels, e.g., 603' as depicted in FIG. 18, to snuggly slide into a position in a rail until the strap is contiguous with, or substantially or relatively next to, another strap (as depicted in FIG. 18) or a rail stop (not shown); however, rail opening 619' would be sufficiently small to prevent removal of a rivet-fastened strap end from the channel (e.g., from exemplary channel 603' depicted in FIGS. 13 and 18; exemplary channel 603" depicted in FIGS. 14A and 14B; and exemplary channel 603 depicted in FIG. 15).

As will be further understood by someone with ordinary skill in the art, although the size of the rail opening 619' would be sufficiently large to allow straps 1010 with riveted ends in rail channels, e.g., 603' as depicted in FIG. 18, to snuggly slide into a position in a rail, e.g., until the strap is contiguous with, or substantially or relatively next to, another strap (as depicted in FIG. 18) or a rail stop (not shown); rail opening 619 would be sufficiently small to resist one strap from overriding or overlapping a contiguous or neighboring strap, or otherwise bunching together. Further, exemplary strap assemblies fastened at each respective end with rivets or other fasteners as disclosed herein would tend to resist overriding or overlapping a contiguous or neighboring strap. Further, in an exemplary embodiment of exemplary strap assemblies fastened, such as each end, to exemplary continuous strips as further described below with respect to, e.g., FIGS. 21-26, such exemplary continuous strips may comprise and, depending on the material of which such strips are made, may tend to maintain, exemplary spacing intervals (e.g., 2100 depicted in FIGS. 21 and 22).

Figure 16:
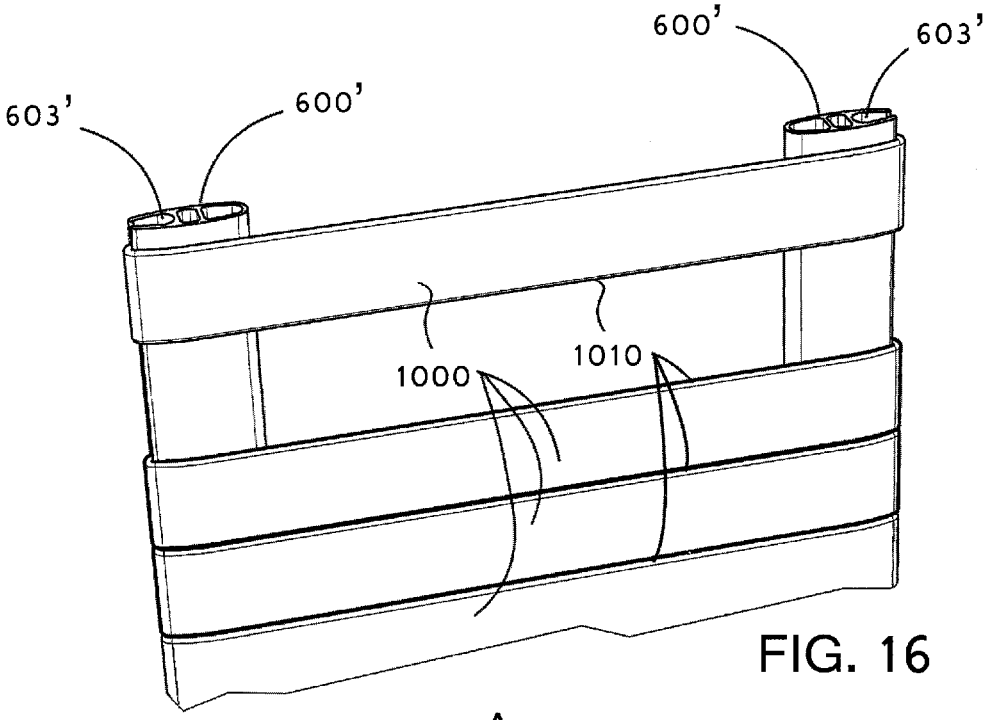
FIG. 16 depicts an exemplary strap that has been inserted into two opposing exemplary exterior side channel rails in an exemplary embodiment of the present invention.
Figure 17:
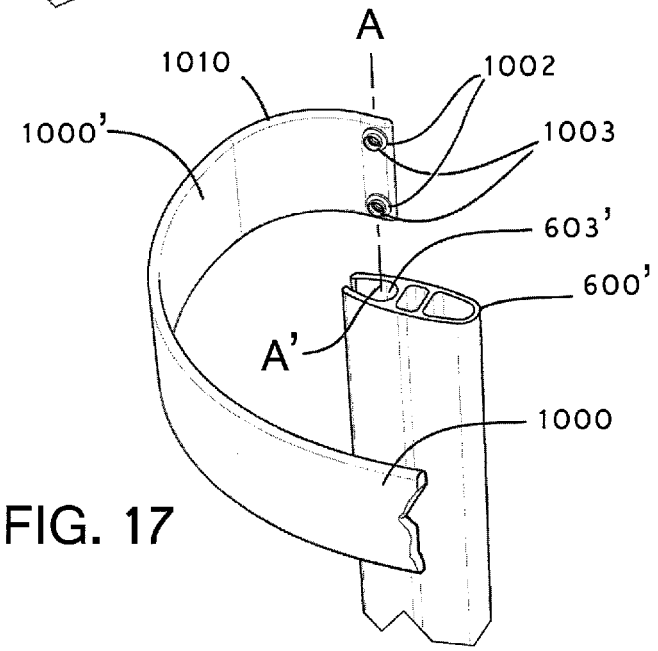
FIG. 17 depicts a perspective view of an exemplary riveted end of a strap positioned for insertion along line A-A' into exemplary exterior side channel in exemplary exterior side channel rail in an exemplary embodiment of the present invention.

FIG. 17 depicts a perspective view of an exemplary riveted end of a strap 1010 positioned for insertion along line A-A' into exemplary exterior side channel 603' in exemplary exterior side channel rail 600'. FIG. 16 depicts an exemplary strap 1010 that has been inserted into two opposing exemplary exterior side channel rails 600'.

As will be understood by someone with ordinary skill in the art, the application of rivets and washers to straps as disclosed herein is a simple function that could be done by someone with limited skills and experience using inexpensive tools. In the event that an expensive sling chair is damaged, the sling element of the chair could be removed, and high-quality straps with rivets attached according to the present invention could be inserted into the existing sling rails. Accordingly, as will be understood by someone with ordinary skill in the art, sling chairs could be retrofitted as strap chairs.

As will further be understood by someone with ordinary skill in the art, as illustratively depicted in the various figures of the present application, straps with rivets attached according to exemplary embodiments of the present invention could be used to convert or retrofit a sling chair to a strap chair, regardless of the channel location (front, exterior side, inner side, rear or some offset variation) in the rails of the sling chair.

Further, as was previously mentioned above, sling chair rails often comprise a corner or radius at a point where the rail that supports the back of the article of furniture transitions into the rail that supports the seat portion of the article of furniture. An exemplary back-to-seat transition curved "radius" is depicted in FIG. 18. As depicted in FIG. 18, end of straps with rivets attached according to exemplary embodiments of the present invention would be flexible so that the ends of such straps could be slid through a channel, e.g. 603', around such a back-to-seat transition curved "radius" so that the subject strap could be slid into a position either in the seat portion of the article of furniture, or could be maintained at the radius.

As will be understood by someone with ordinary skill in the art, rivets or other fasteners, and washers, of various sizes could be used without departing from the spirit of the present invention.

Further, as will be understood by someone with ordinary skill in the art, exemplary chair rails and chair rail channel configurations have been illustrated herewith, but are not a limitation of the present invention. Other chair rail configurations and/or chair rail channel configurations could be used without departing from the spirit of the present invention; the combination of the size of the strap, rivet and washer (or other end fasteners and/or strips and/or clips) would need to fit in the channel in the rail of the article of furniture to be made and/or repaired and/or converted or retrofit, but would need to be of sufficient size that the combination of the strap end, rivets and washers (or other end fasteners and/or strips and/or clips) would be able to be slid through the rail channel; the channel opening 619, e.g., as depicted in FIGS. 13, 14A-B and 15, would need to be sufficiently large to allow a snug sliding of the strap 1010 and would need to be sufficiently small to resist extraction of the riveted (or otherwise fastened) end of the strap through the channel opening 619.

Yet further, as will be understood by someone with ordinary skill in the art, exemplary embodiments of the present invention could use various widths of straps, various colors of straps and/or various materials of straps for a single chair.

FACSIMILE REPRODUCTION OF COPYRIGHT MATERIAL

A portion of the disclosure of this patent document contains material which is subject to copyright protection by the copyright owner, John W. Caldwell and/or his successors and assigns. The copyright owner has no objection to the facsimile reproduction by anyone of the patent document or the patent disclosure, as it appears in the Patent and Trademark Office patent file or records, but otherwise reserves all copyright rights whatsoever.

ILLUSTRATIVE EMBODIMENTS

Although this invention has been described in certain specific embodiments, many additional modifications and variations would be apparent to those skilled in the art. It is, therefore, to be understood that this invention may be practiced otherwise than as specifically described. Moreover, to those skilled in the various arts, the invention itself herein will suggest solutions to other tasks and adaptations for other applications. Thus, the embodiments of the invention described herein should be considered in all respects as illustrative and not restrictive, the scope of the invention to be determined by the appended claims and their equivalents rather than the foregoing description.

What is claimed is:

1. An article of furniture, said article of furniture comprising:

a first side rail comprising a first channel traversing a length of said first side rail, said first channel comprising a first channel opening that traverses the length of said first side rail;

a second side rail comprising a second channel traversing a length of said second side rail, said second channel comprising a second channel opening that traverses the length of said second side rail, said second side rail opposing said first side rail and said second side rail being separated from said first side rail by a space interval; and a first strap comprising a first end and a second end, each of said first end and said second end comprising two respective corner portions, wherein each of said first end and said second end comprises a first respective fastener and a second respective fastener secured in said two respective corner portions, said first fastener and said second fastener of said first end of said first strap being slid into the first channel of said first side rail so that said first strap extends from said first channel through said first channel opening, and said first fastener and said second fastener of said second end of said strap being slid into the second channel of said second side rail so that said second strap extends from said second channel through said second channel opening so that said strap spans said space interval between said first side rail and said second side rail, wherein said first end of said first strap is fastened with said first fastener and said second fastener of said first end to a first continuous strip of material, and wherein said second end of said first strap is fastened with said first fastener and said second fastener of said second end to a second continuous strip of material, said article of furniture further comprising:

a plurality of straps, a first respective portion of each respective strap of said plurality of straps being fastened with a first respective fastener and a second respective fastener to said first continuous strip of material and a second respective portion of each respective strap of said plurality of straps being fastened with a third respective fastener and a fourth respective fastener to said second continuous strip of material.

2. The article of furniture of claim 1, said article of furniture further comprising:

a port in said first channel of said first side rail adapted for insertion of said first fastener and said second fastener of said first end of said strap; and a port in said second channel of said second side rail adapted for insertion of said first fastener and said second fastener of said second end of said strap.

3. The article of furniture of claim 1, said article of furniture further comprising:

a port in said first channel of said first side rail adapted for insertion of said first respective fastener and said second respective fastener of said first respective portion of each respective strap of said plurality of straps; and a port in said second channel of said second side rail adapted for insertion of said third respective fastener and said fourth respective fastener of said second respective portion of each respective strap of said plurality of straps.

4. The article of furniture of claim 3, said article of furniture further comprising:

said first continuous strip of material being inserted into and slid through said first port in said first channel and said second continuous strip of material being inserted into and slid through said second port in said second channel, so that said first and second continuous strips of material traverse a respective portion of said first and second side rails so that said plurality of straps span said space interval between said first side rail and said second side rail.

5. The article of furniture of claim 1, said article of furniture further comprising:

said first continuous strip of material being inserted into said first channel, and said second continuous strip of material being inserted into said second channel so that said first and second continuous strips of material traverse a respective portion of said first and second side rails so that said plurality of straps span said space interval between said first side rail and said second side rail.

6. The article of furniture of claim 1, wherein said first fastener and said second fastener of said first end of said first strap resist extraction through said first channel opening.

7. The article of furniture of claim 1, wherein said first channel opening comprises a first channel opening width, wherein said first channel comprises a first channel width, wherein said first channel opening width is smaller than said first channel width, wherein said first fastener and said second fastener of said first end of said first strap resist extraction through said first channel opening.

8. The article of furniture of claim 1, said first channel comprising a wherein said first fastener and said second fastener of said first end of said first strap resist extraction through said first channel opening, and wherein said first fastener and said second fastener of said second end of said first strap resist extraction through said second channel opening.

9. An article of furniture, said article of furniture comprising:

a first side rail, said first side rail comprising a first length and a first channel that traverses at least a portion of the first length of said first side rail, said first channel comprising a first channel width and further comprising a first channel opening that traverses said at least said portion of the first length of the first side rail, said first channel opening comprising a first channel opening width that is smaller than said first channel width;

a second side rail, said second side rail comprising a second length and a second channel that traverses at least a portion of the second length of said second side rail, said second channel comprising a second channel width and further comprising a second channel opening that traverses said at least said portion of the second length of the second side rail, said second side rail positioned at a distance from said first side rail, said second channel opening comprising a second channel opening width that is smaller than said second channel width;

a first strap, said first strap comprising a top surface and a bottom surface, said first strap further comprising a first end and a second end, said first strap further comprising a first strap body, said first strap further comprising:

a first fastener fastened into a first corner portion of said first end of said first strap, a second fastener fastened into a second corner portion of said first end of said first strap, a third fastener fastened into a first corner portion of said second end of said first strap, and a fourth fastener fastened into a second corner portion of said second end of said first strap;

said first fastener and said second fastener of said first end of said first strap slidably positioned in said first channel;

said third fastener and said fourth fastener of said second end of said first strap slidably positioned in said second channel;

said first strap body traversing the distance between from said first side rail to said second side rail, wherein each of said first, second, third and fourth fastener comprises a respective head end, a respective shaft, a respective tail end, and a respective tail end fastening portion, wherein each respective tail end fastening portion is fastened on said respective tail end against the bottom surface, thereby securing said respective tail end of said respective fastener from extraction from said first strap.

10. The article of furniture of claim 9, wherein:

said first fastener and said second fastener resist extraction of said first end of said first strap through said first channel opening; and said third fastener and said fourth fastener resist extraction of said second end of said first strap through said second channel opening.

11. The article of furniture of claim 9, said first strap comprising a sling, wherein said first strap body comprises a width that traverses said portion of the first length of the first side rail.

* * * * *